US010906617B2

(12) United States Patent
Zucchelli et al.

(10) Patent No.: US 10,906,617 B2
(45) Date of Patent: Feb. 2, 2021

(54) FLOTATION AID

(71) Applicants: Joanne Drew Zucchelli, Stockton, CA (US); Debra Ehrlich May, Stockton, CA (US)

(72) Inventors: Joanne Drew Zucchelli, Stockton, CA (US); Debra Ehrlich May, Stockton, CA (US)

( * ) Notice: Subject to any disclaimer, the term of this patent is extended or adjusted under 35 U.S.C. 154(b) by 0 days.

(21) Appl. No.: 16/410,366

(22) Filed: May 13, 2019

(65) Prior Publication Data

US 2019/0337600 A1 Nov. 7, 2019

Related U.S. Application Data

(63) Continuation of application No. 29/646,657, filed on May 7, 2018, now Pat. No. Des. 853,514, and a continuation of application No. 29/646,648, filed on May 7, 2018, now Pat. No. Des. 853,510, and a continuation of application No. 29/646,650, filed on May 7, 2018, now Pat. No. Des. 853,512, and a continuation of application No. 29/646,656, filed on May 7, 2018, now Pat. No. Des. 853,513, and a continuation of application No. 29/646,647, filed on May 7, 2018, now Pat. No. Des. 853,509, and a continuation of application No. 29/646,658, filed on May 7, 2018, now Pat. No. Des. 853,508, and a continuation of application No. 29/646,649, filed on May 7, 2018, now Pat. No. Des. 853,511.

(51) Int. Cl.
*B63C 9/08* (2006.01)

(52) U.S. Cl.
CPC ..... *B63C 9/08* (2013.01)

(58) Field of Classification Search
CPC ..... B63C 9/08; A63H 23/10; A63H 23/00
See application file for complete search history.

(56) References Cited

U.S. PATENT DOCUMENTS

| | | | | |
|---|---|---|---|---|
| D169,242 | S | 4/1953 | Dinhofer | |
| D236,287 | S | 8/1975 | McNair et al. | |
| D279,668 | S | 7/1985 | Larsson | |
| D281,261 | S | 11/1985 | Stubbmann | |
| D290,474 | S | 6/1987 | Tepper | |
| D300,194 | S | 3/1989 | Walker | |
| D304,751 | S | 11/1989 | Wolfe | |
| D310,313 | S | 9/1990 | Afeyan | |
| 5,044,030 | A | 9/1991 | Balaton | |
| D325,068 | S | 3/1992 | Gaury | |
| 5,890,245 | A | 4/1999 | Klearman et al. | |
| 5,918,336 | A | 7/1999 | Lee et al. | |
| 6,027,393 | A | 2/2000 | O'Rourke | |
| 6,058,536 | A | 5/2000 | Henry | |
| D433,899 | S | 11/2000 | Saffron | |
| 6,176,047 | B1 * | 1/2001 | Morningstar | A01M 29/06 40/538 |
| D455,928 | S | 4/2002 | Fisher et al. | |
| D469,495 | S * | 1/2003 | Greenberg | D21/598 |

(Continued)

*Primary Examiner* — Anthony D Wiest
(74) *Attorney, Agent, or Firm* — Maier & Maier, PLLC

(57) ABSTRACT

A flotation aid may be provided. The flotation aid can include a head portion, an elongated central portion, and a tail portion. The head portion may be in the shape of an animal head. The tail portion may be in the shape of an animal tail. The elongated central portion may further have a plurality of ribs disposed on a top surface.

7 Claims, 24 Drawing Sheets

(56) References Cited

U.S. PATENT DOCUMENTS

| | | | | | |
|---|---|---|---|---|---|
| D471,051 | S | | 3/2003 | Cook | |
| D472,382 | S | | 4/2003 | Larsen | |
| 7,045,194 | B2 | | 5/2006 | Sneed | |
| 7,318,762 | B2 | | 1/2008 | Goldmeier et al. | |
| D575,834 | S | | 8/2008 | Welch | |
| D584,911 | S | | 1/2009 | Hisey et al. | |
| D586,530 | S | | 2/2009 | Madsen | |
| D621,449 | S | | 8/2010 | Wong | |
| D708,690 | S | | 7/2014 | Liberatore | |
| D736,335 | S | | 8/2015 | Liberatore | |
| D741,435 | S | | 10/2015 | Brown et al. | |
| D747,776 | S | | 1/2016 | Norman et al. | |
| D753,780 | S | * | 4/2016 | Rubey | D21/803 |
| D758,201 | S | | 6/2016 | Sehl | |
| D776,207 | S | | 1/2017 | Norman et al. | |
| D783,106 | S | | 4/2017 | Liberatore | |
| D803,947 | S | | 11/2017 | Lo et al. | |
| D823,966 | S | | 7/2018 | Berenson | |
| 2010/0197192 | A1 | * | 8/2010 | Johnston | A63H 23/04<br>446/159 |

* cited by examiner

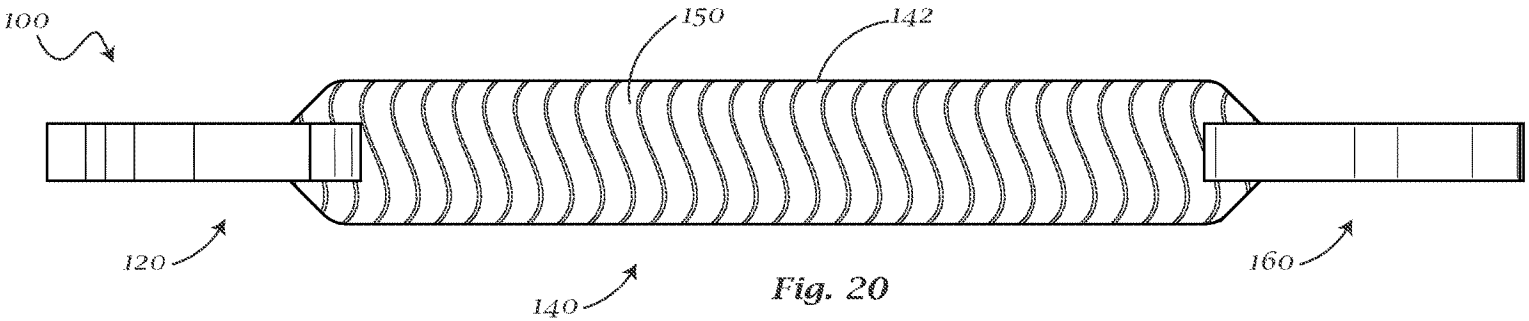
Fig. 20
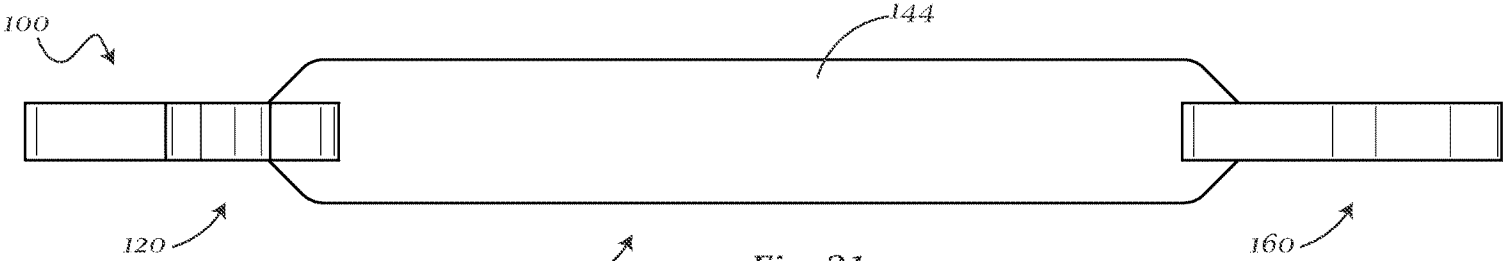
Fig. 21
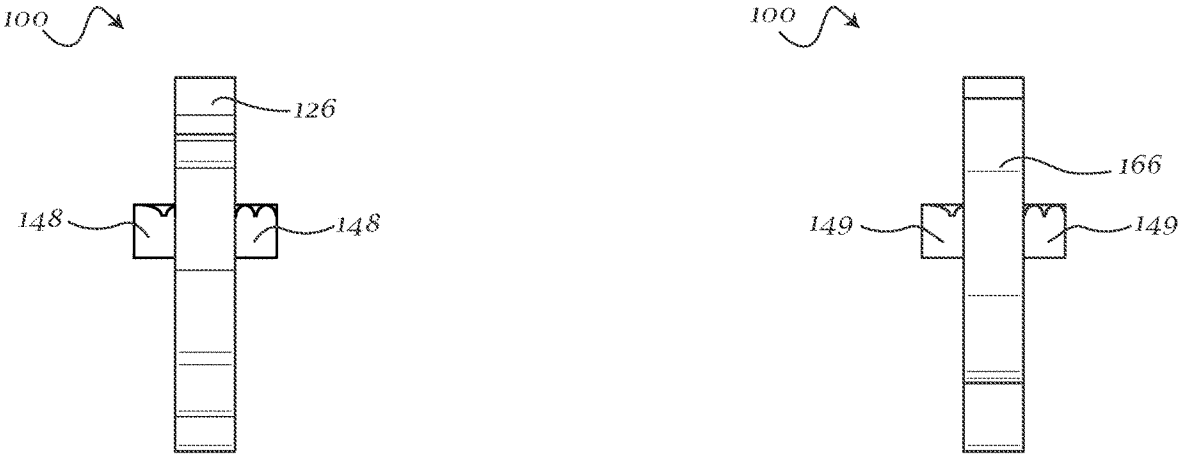
Fig. 22
Fig. 23

FLOTATION AID

CROSS-REFERENCE TO RELATED APPLICATIONS

This present patent application claims benefit and priority as a continuation of pending U.S. Design patent application Ser. No. 29/646,647, filed May 7, 2018 and titled "Flotation Aid," the disclosure of which is incorporated by reference herein in its entirety. Furthermore, this present patent application claims benefit and priority as a continuation of pending U.S. Design patent application Ser. No. 29/646,648, filed May 7, 2018 and titled "Flotation Aid," the disclosure of which is incorporated by reference herein in its entirety. Furthermore, this present patent application claims benefit and priority as a continuation of pending U.S. Design patent application Ser. No. 29/646,649, filed May 7, 2018 and titled "Flotation Aid," the disclosure of which is incorporated by reference herein in its entirety. Furthermore, this present patent application claims benefit and priority as a continuation of pending U.S. Design patent application Ser. No. 29/646,650, filed May 7, 2018 and titled "Flotation Aid," the disclosure of which is incorporated by reference herein in its entirety. Furthermore, this present patent application claims benefit and priority as a continuation of pending U.S. Design patent application Ser. No. 29/646,656, filed May 7, 2018 and titled "Flotation Aid," the disclosure of which is incorporated by reference herein in its entirety. Furthermore, this present patent application claims benefit and priority as a continuation of pending U.S. Design patent application Ser. No. 29/646,657, filed May 7, 2018 and titled "Flotation Aid," the disclosure of which is incorporated by reference herein in its entirety. Furthermore, this present patent application claims benefit and priority as a continuation of pending U.S. Design patent application Ser. No. 29/646,658, filed May 7, 2018 and titled "Flotation Aid," the disclosure of which is incorporated by reference herein in its entirety.

BACKGROUND

Water flotation aids and devices have been popular for recreational and exercise activities in the water. Flotation aids are popular among all ages and may typically have generic shapes. It therefore may be desired to have an improved flotation aid.

SUMMARY

According to an exemplary embodiment, a flotation aid may be provided. The flotation aid may have a head portion in the shape of an animal head. The flotation aid may have an elongated central portion connected to the head portion. The elongated central portion may have a rectangular cross-section. The flotation aid may have a tail portion connected to the elongated central portion and the tail portion may be in the shape of an animal tail corresponding to the animal head.

According to another exemplary embodiment, a flotation aid may be provided. The flotation aid may have a head portion, an elongated central portion connected to the head portion and a tail portion connected to the elongated central portion. The flotation aid may further have a plurality of ribs disposed on a top surface of the elongated central portion.

BRIEF DESCRIPTION OF THE FIGURES

Advantages of embodiments of the present invention will be apparent from the following detailed description of the exemplary embodiments. The following detailed description should be considered in conjunction with the accompanying figures in which:

Exemplary
FIG. 20 is a top view thereof;
FIG. 21 is a bottom view thereof;
FIG. 22 is a front view thereof;
FIG. 23 is a rear view thereof.

DETAILED DESCRIPTION

Figure 1:
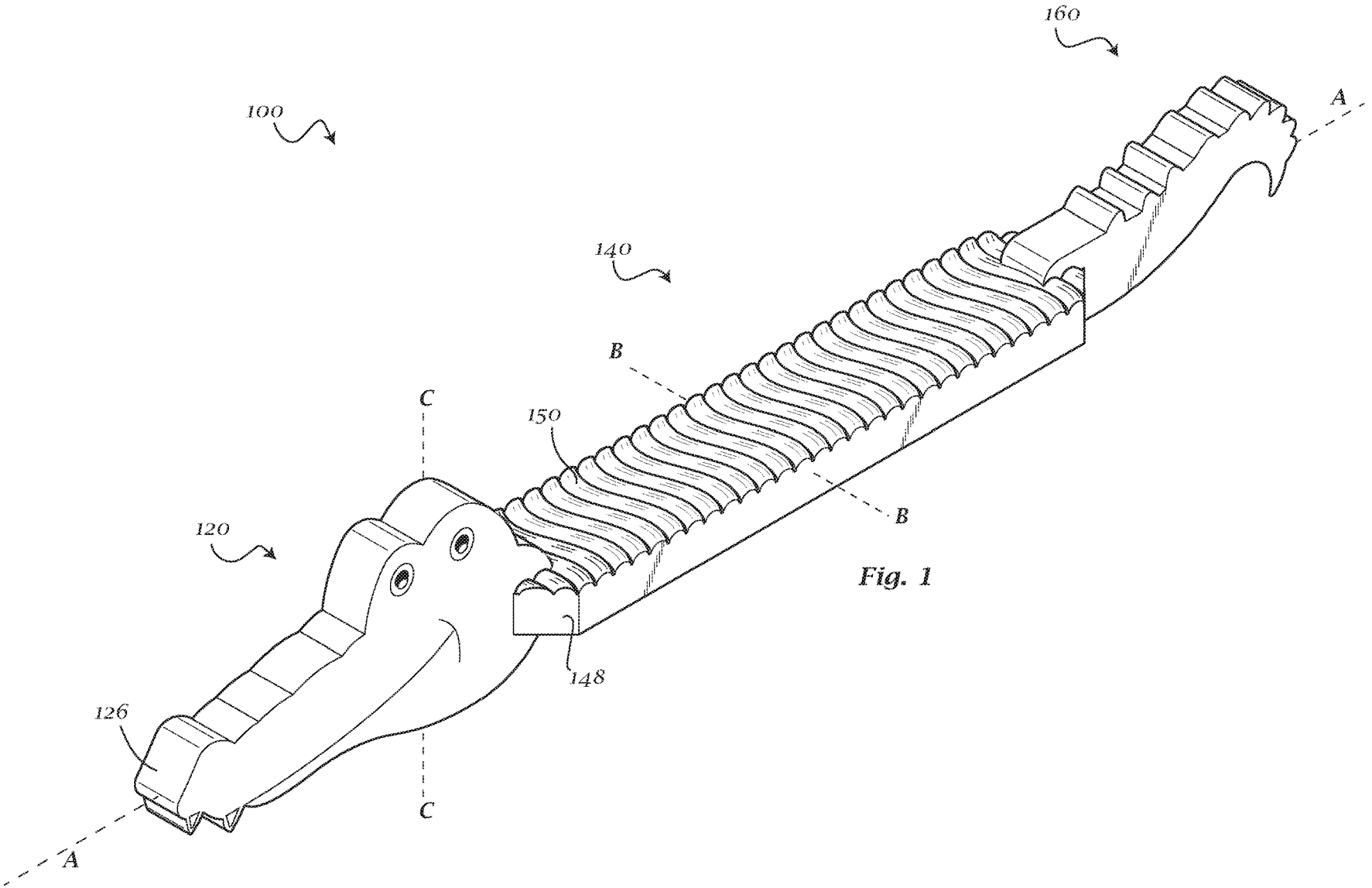
FIG. 1 is a perspective view of a flotation aid.
Figure 2:
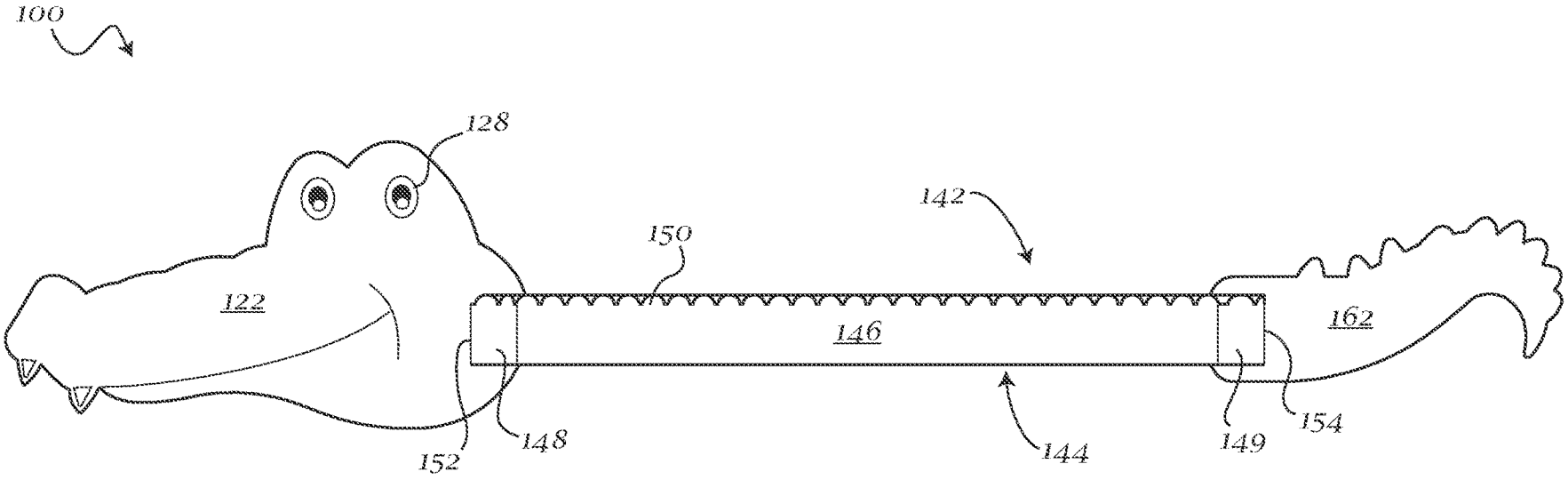
FIG. 2 is a right side view thereof.
Figure 3:
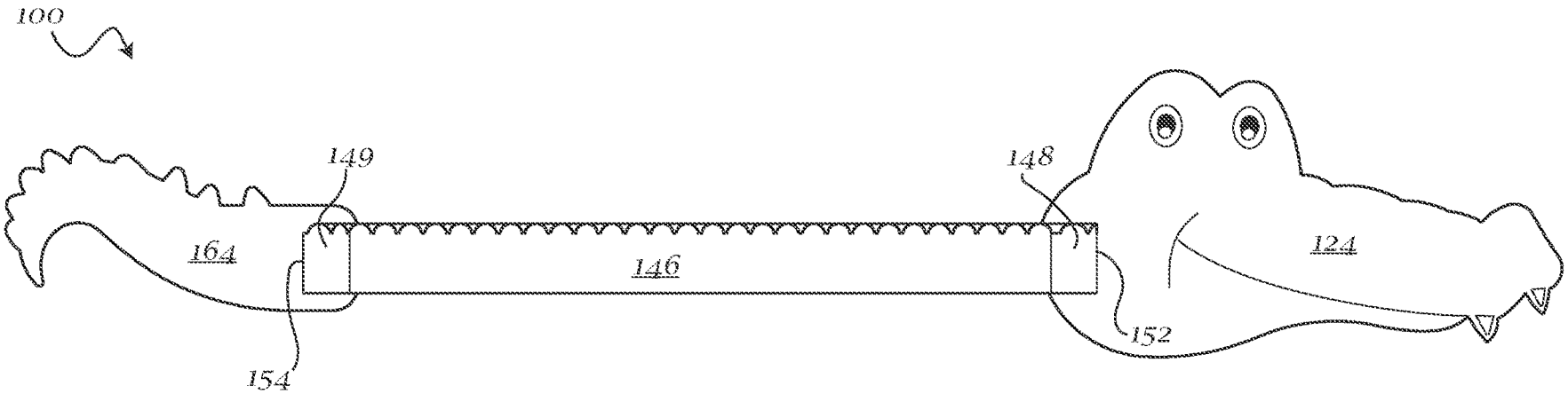
FIG. 3 is a left side view thereof.
Figure 4:
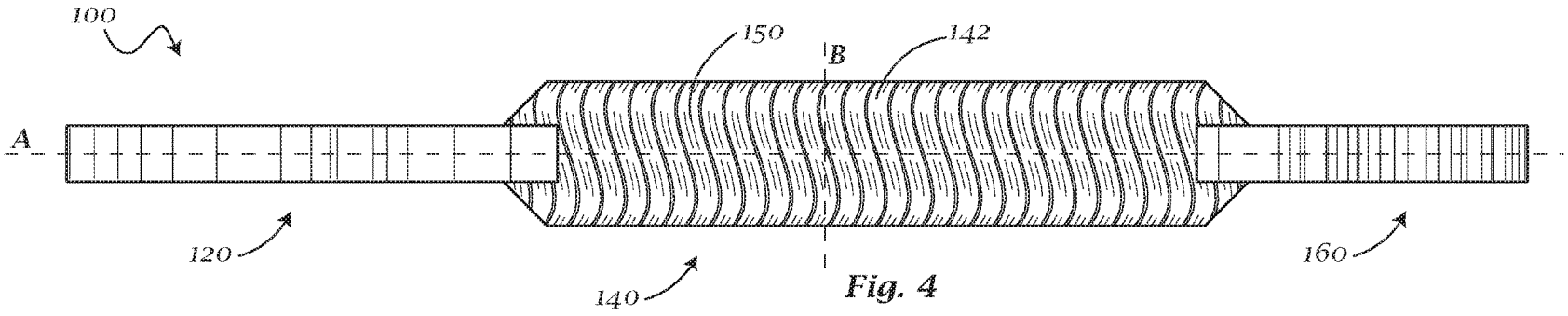
FIG. 4 is a top view thereof.
Figure 5:
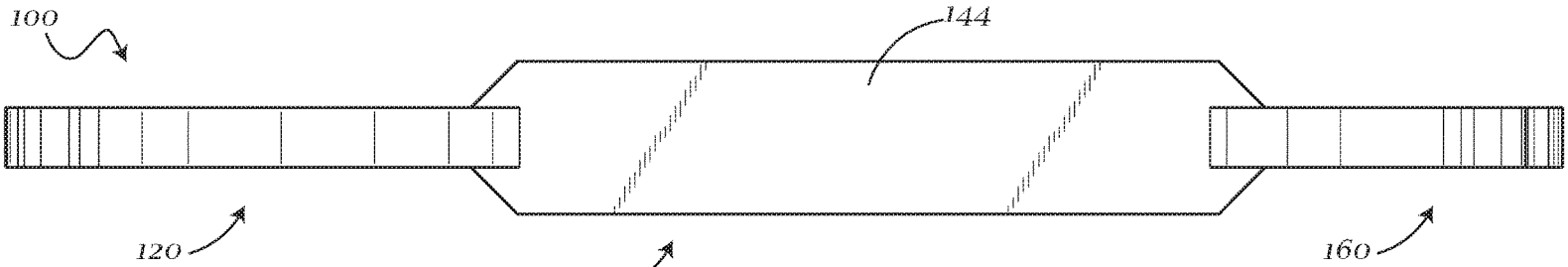
FIG. 5 is a bottom view thereof.
Figure 7:
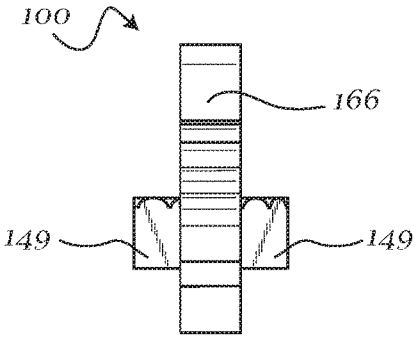
FIG. 7 is a rear view thereof.
Figure 6:
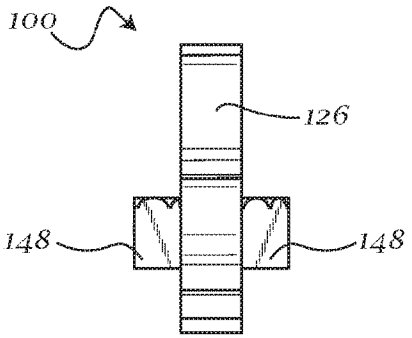
FIG. 6 is a front view thereof.
Figure 8:
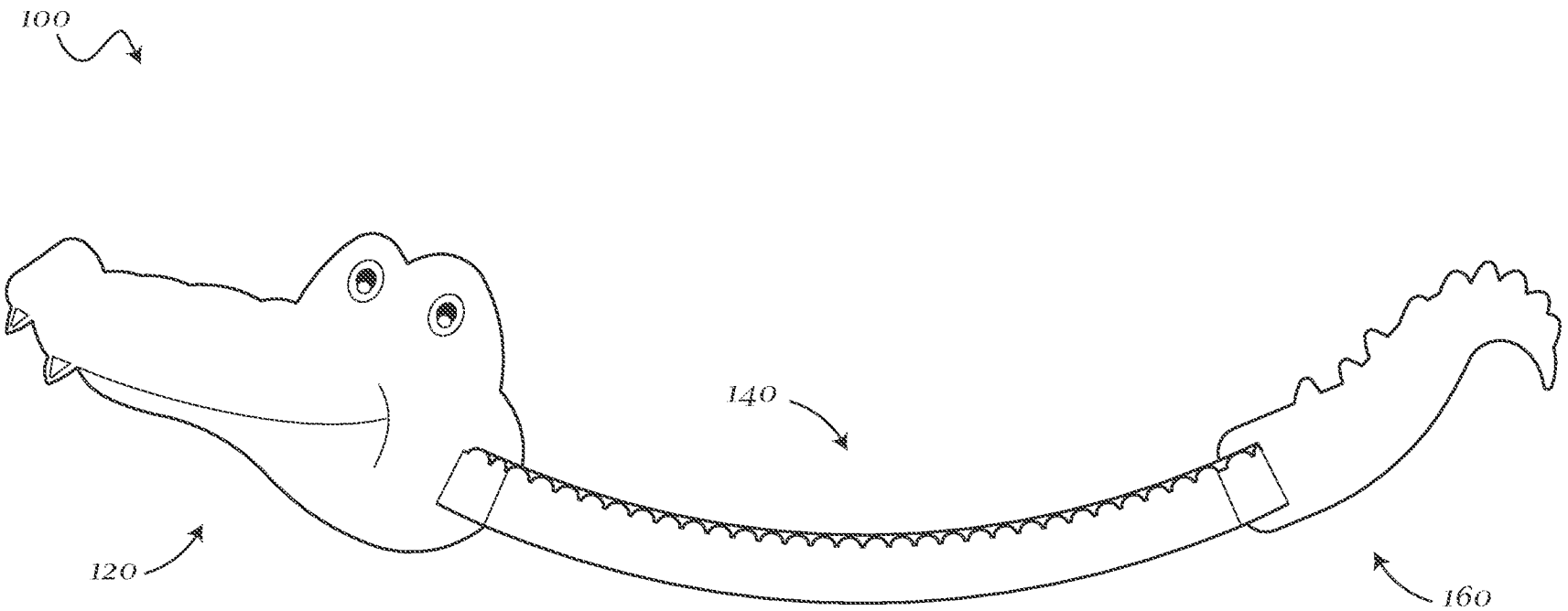
FIG. 8 is a right side view thereof, showing the Flotation Aid in an alternate orientation.
Figure 9:
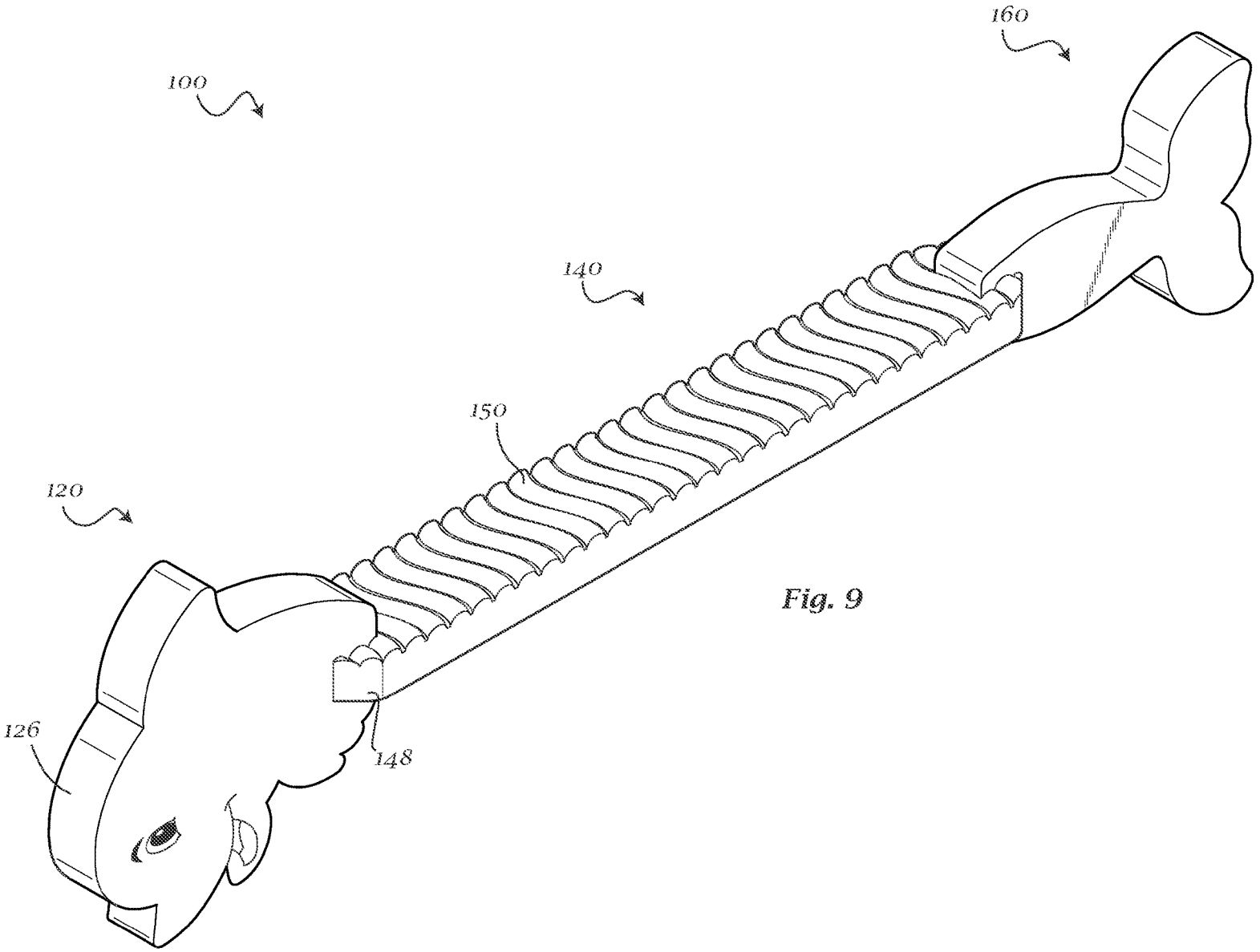
FIG. 9 is a perspective view of another embodiment of a flotation aid.
Figure 10:
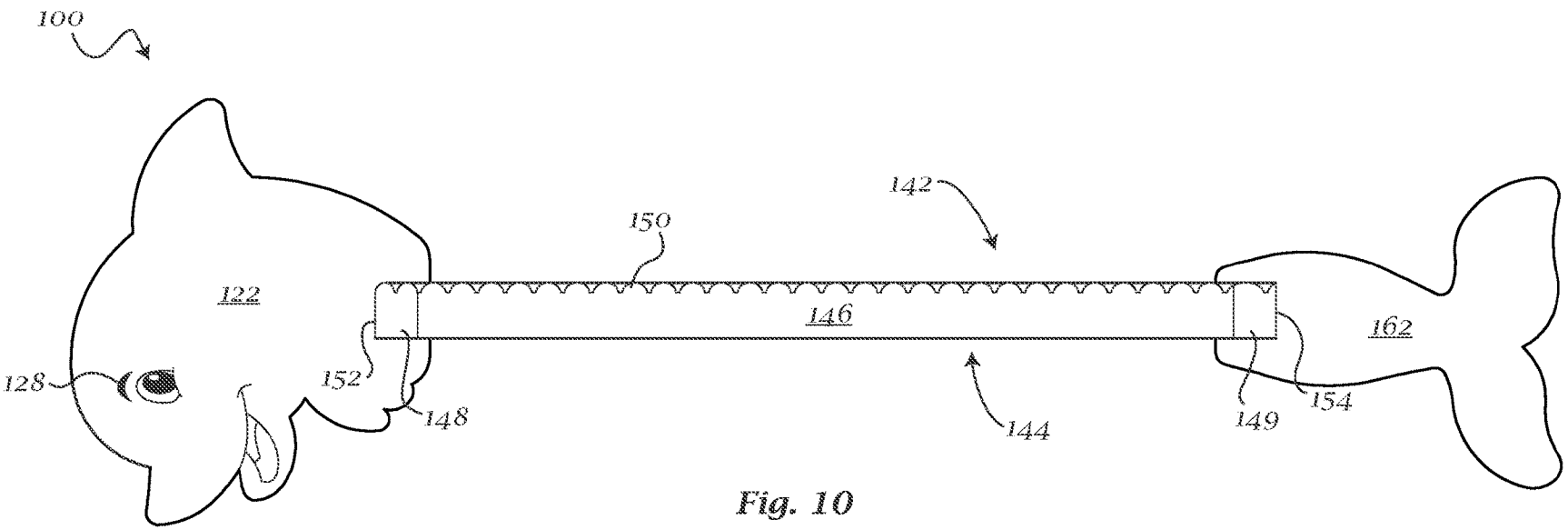
FIG. 10 is a right side view thereof.
Figure 11:
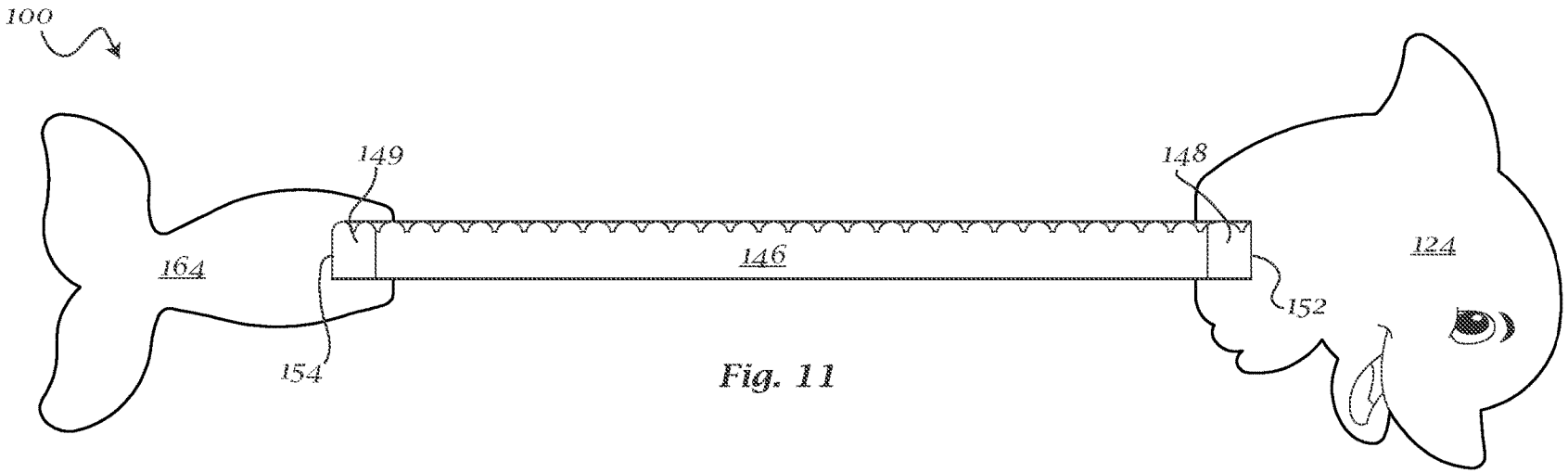
FIG. 11 is a left side view thereof.
Figure 12:
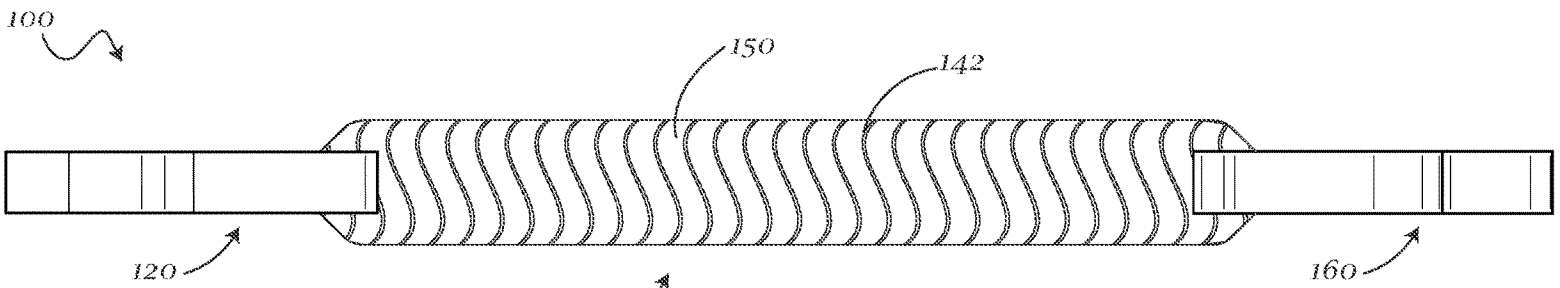
FIG. 12 is a top view thereof.
Figure 13:
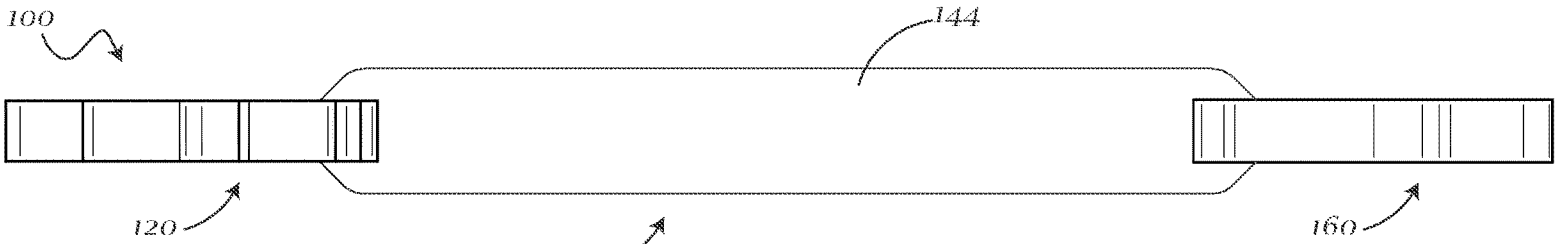
FIG. 13 is a bottom view thereof.
Figure 15:
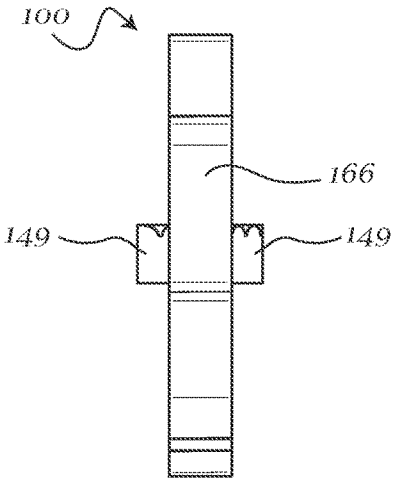
FIG. 15 is a rear view thereof.
Figure 14:
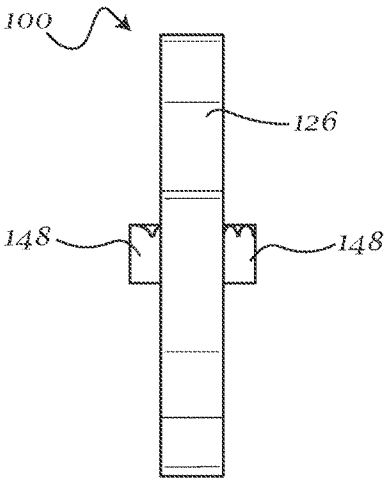
FIG. 14 is a front view thereof.
Figure 16:
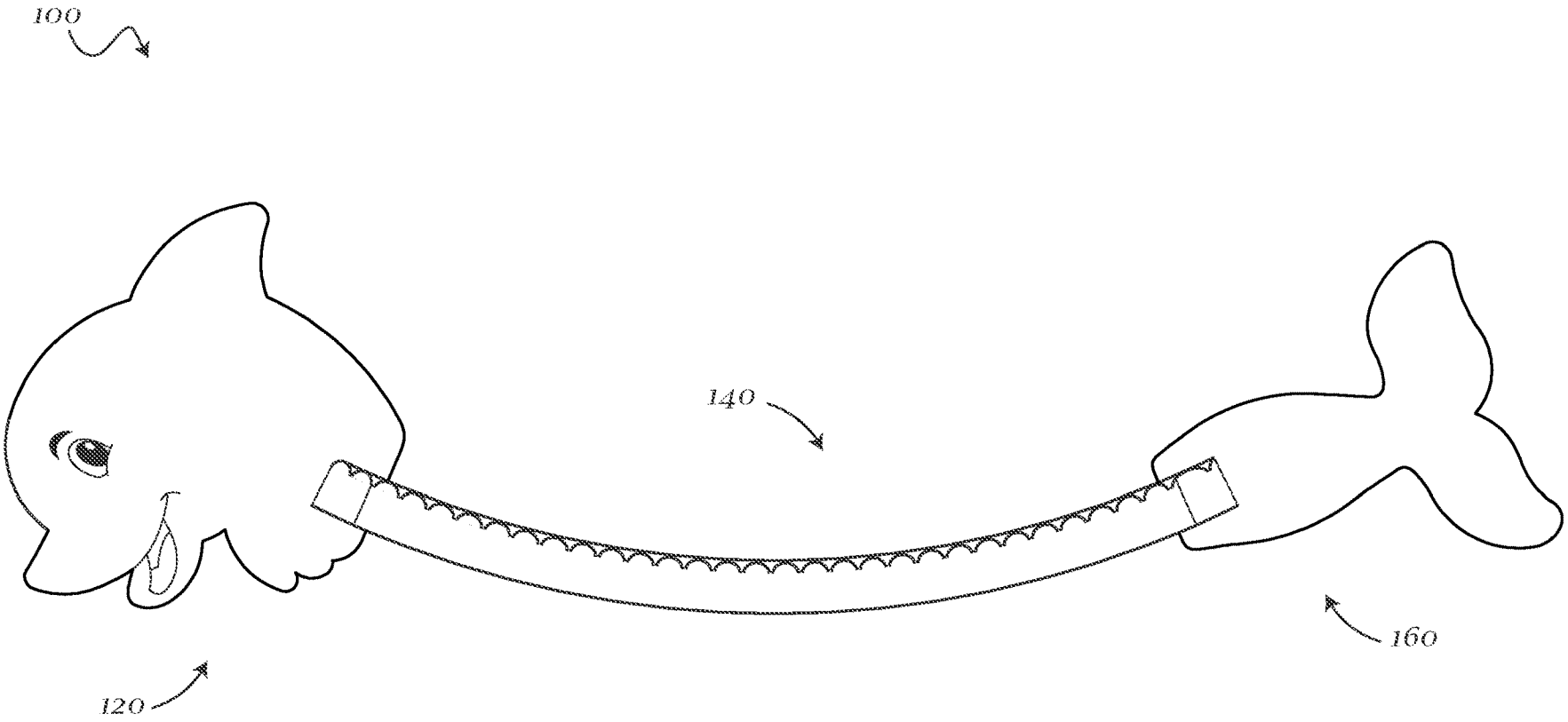
FIG. 16 is a right side view thereof, shown in an alternate orientation.
Figure 17:
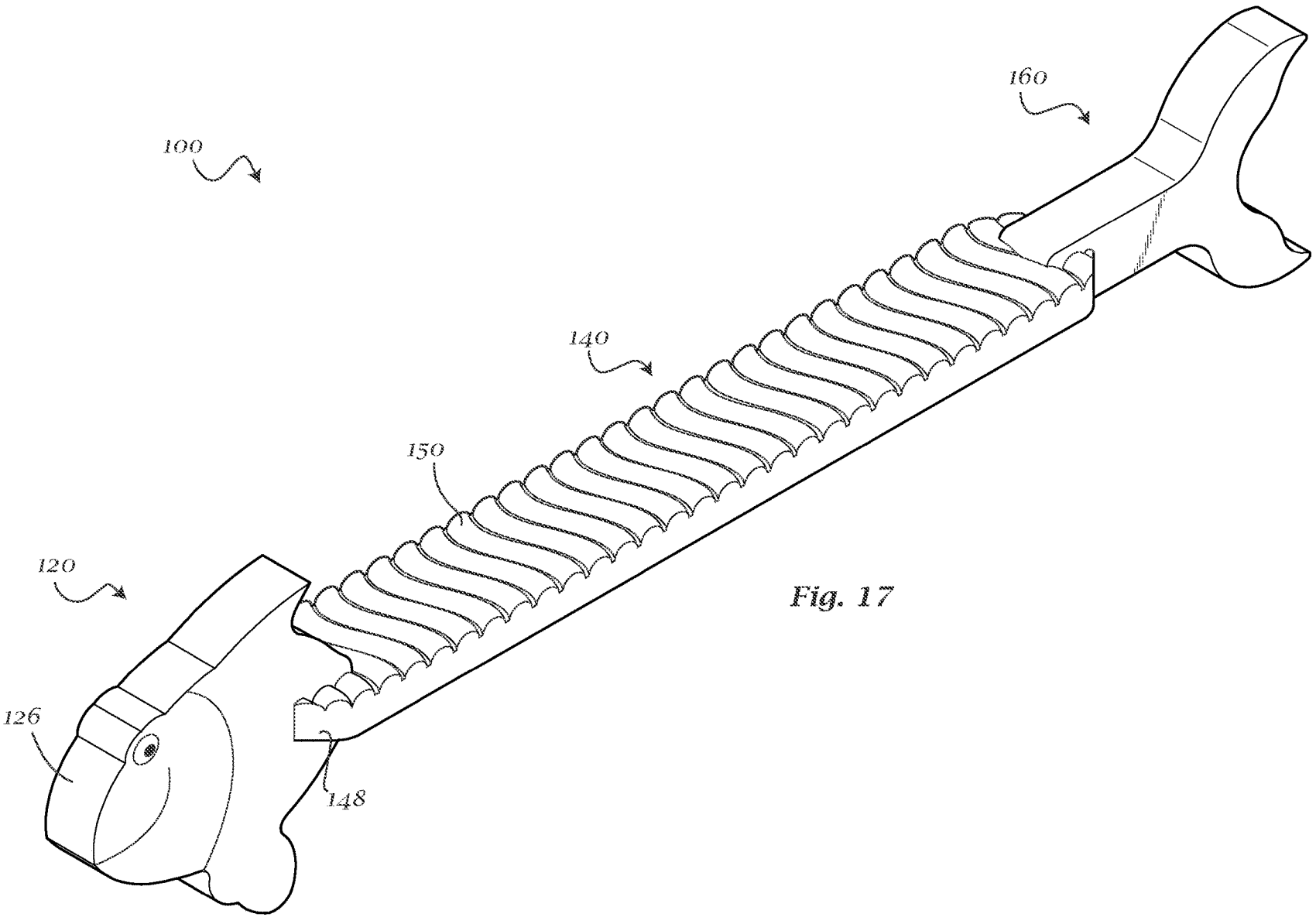
FIG. 17 is a perspective view of another embodiment of a flotation aid.
Figure 18:
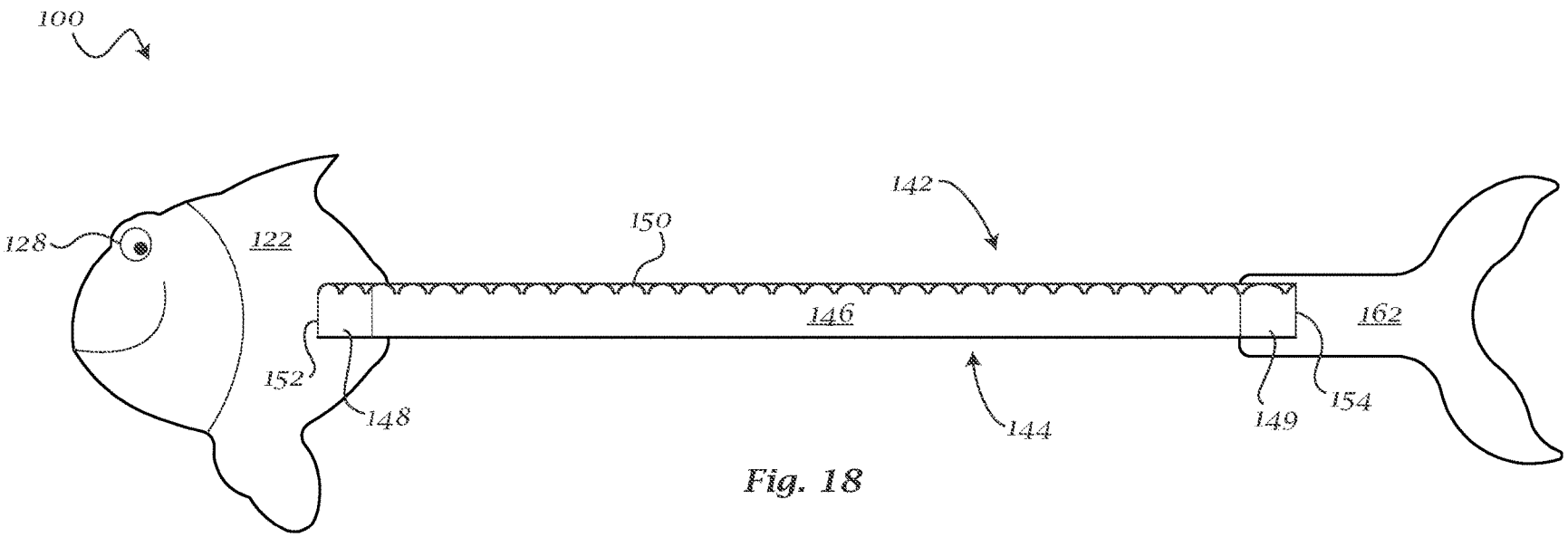
FIG. 18 is a right side view thereof.
Figure 19:
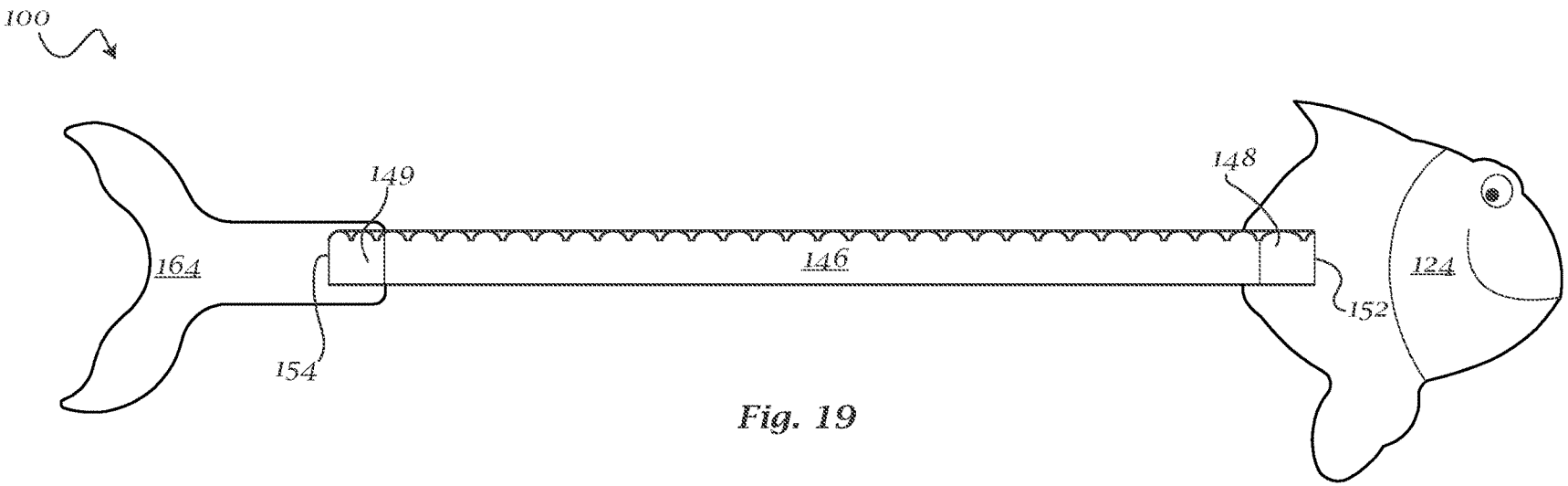
FIG. 19 is a left side view thereof.
Figure 24:
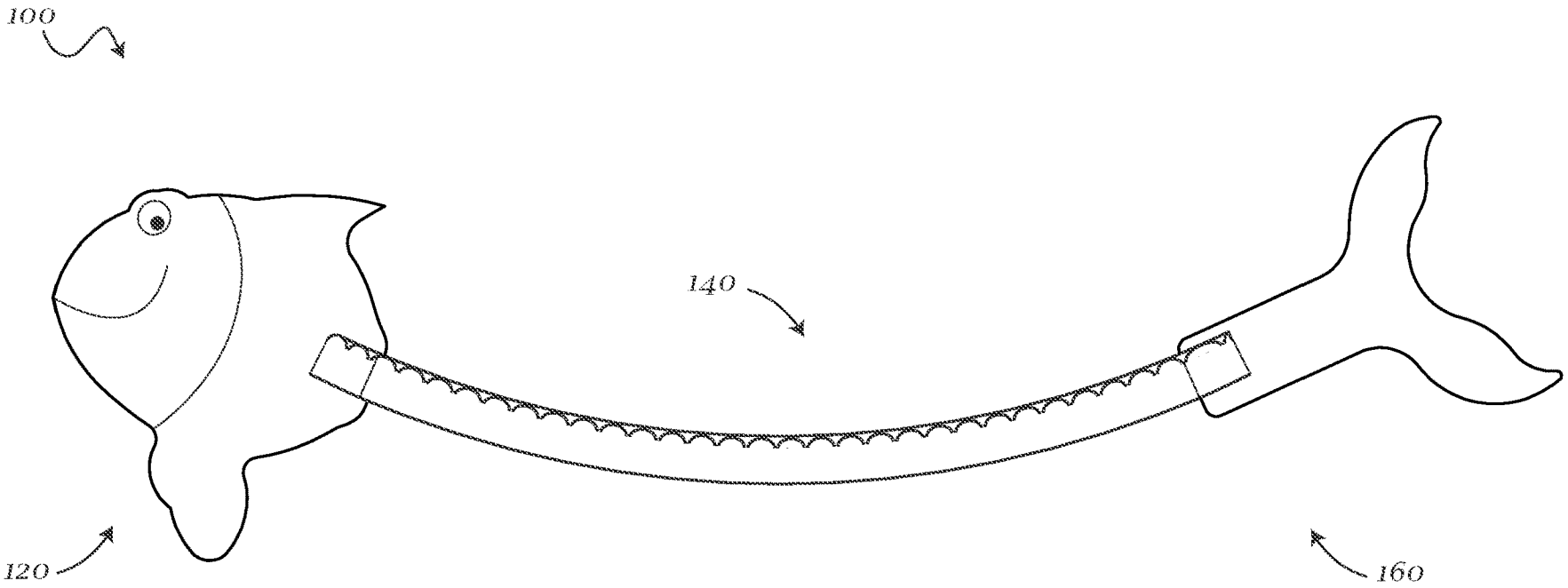
FIG. 24 is a right side view thereof, shown in an alternate orientation.
Figure 25:
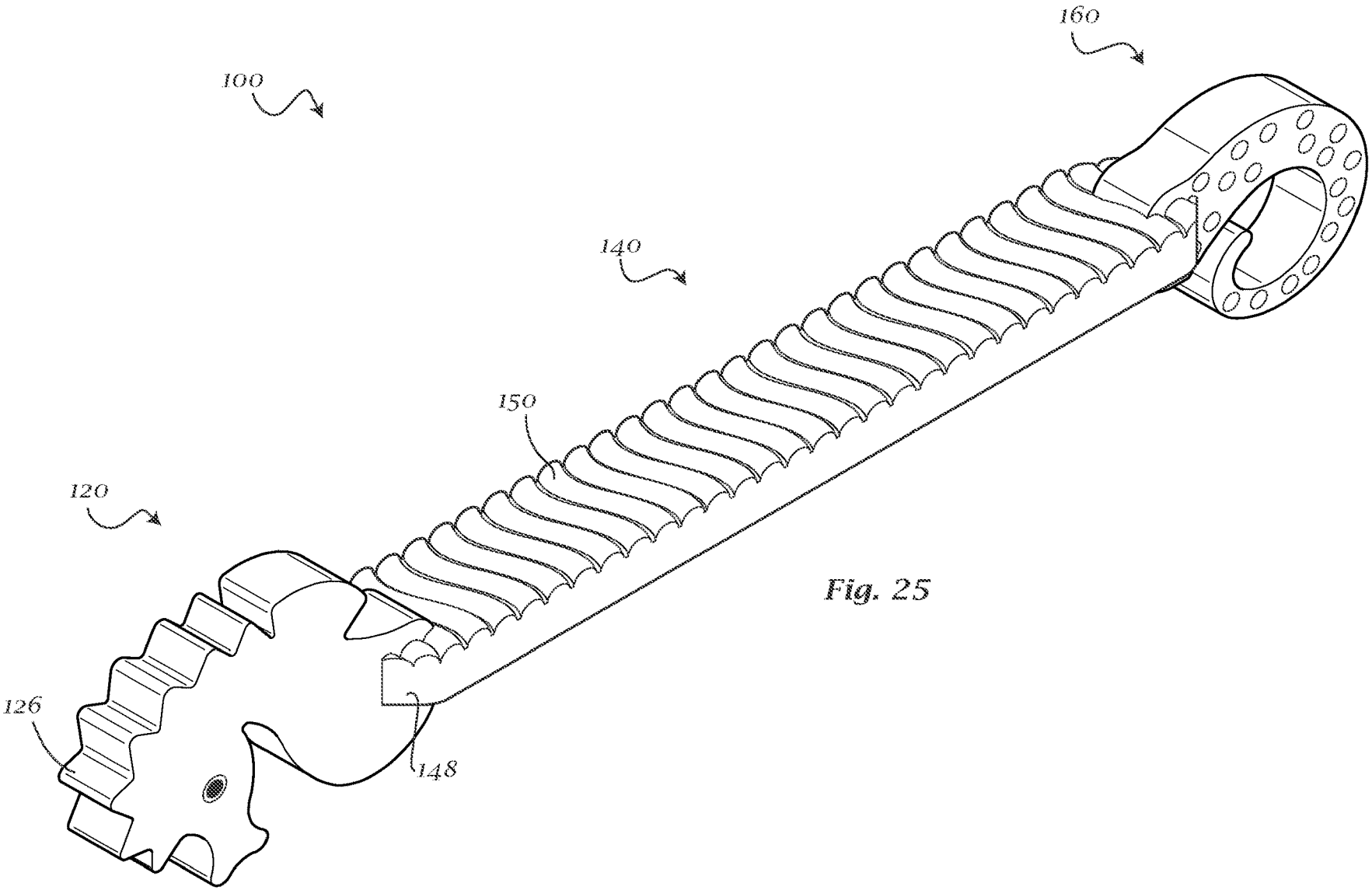
FIG. 25 is a perspective view of another embodiment of a flotation aid.
Figure 26:
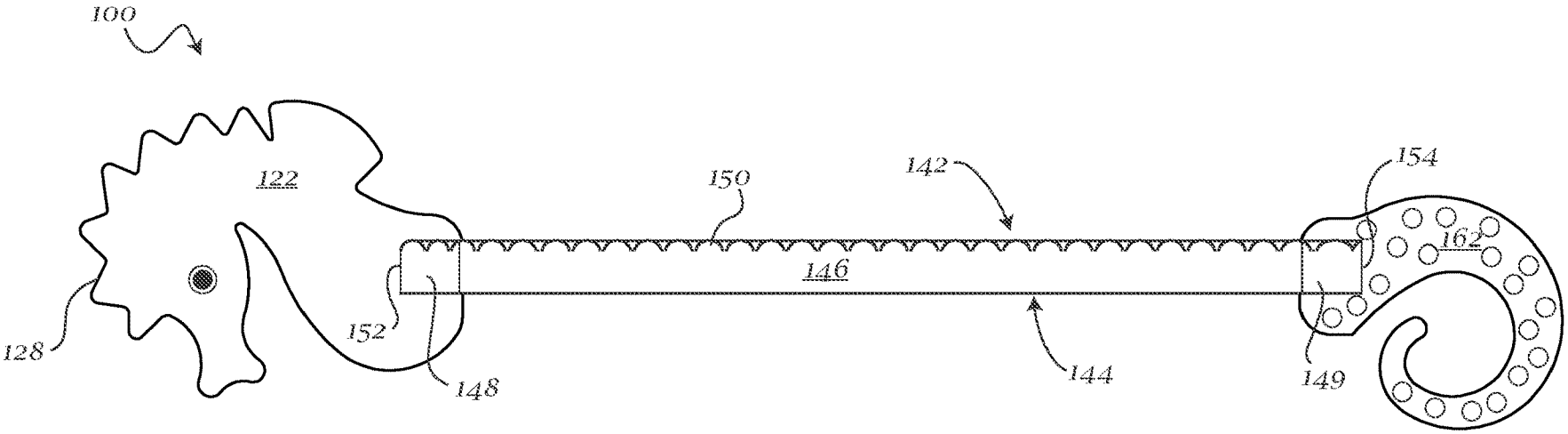
FIG. 26 is a right side view thereof.
Figure 27:
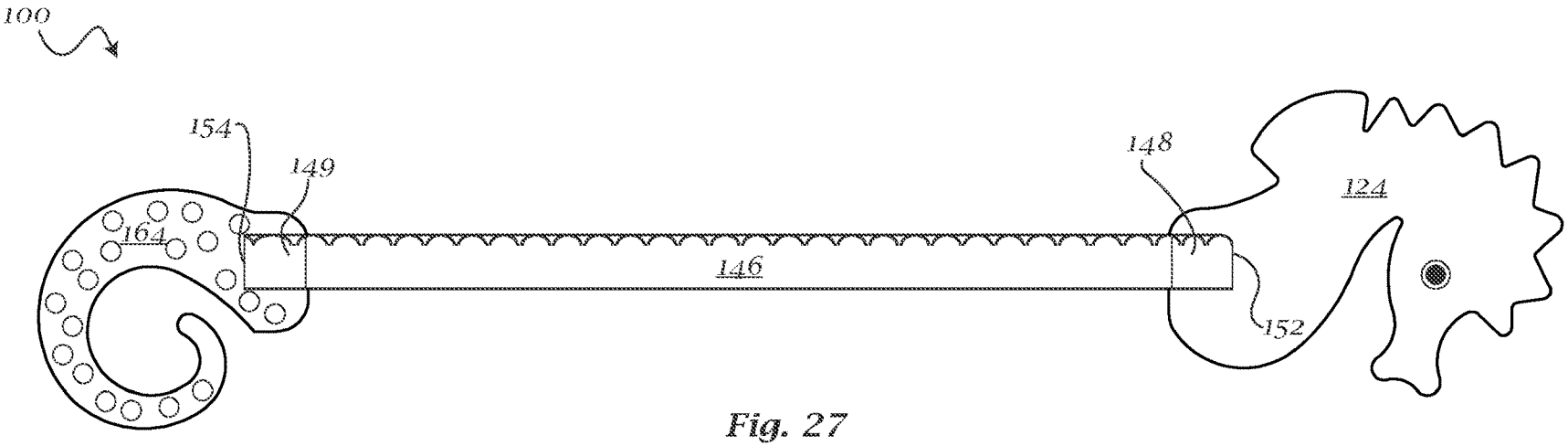
FIG. 27 is a left side view thereof.
Figure 28:
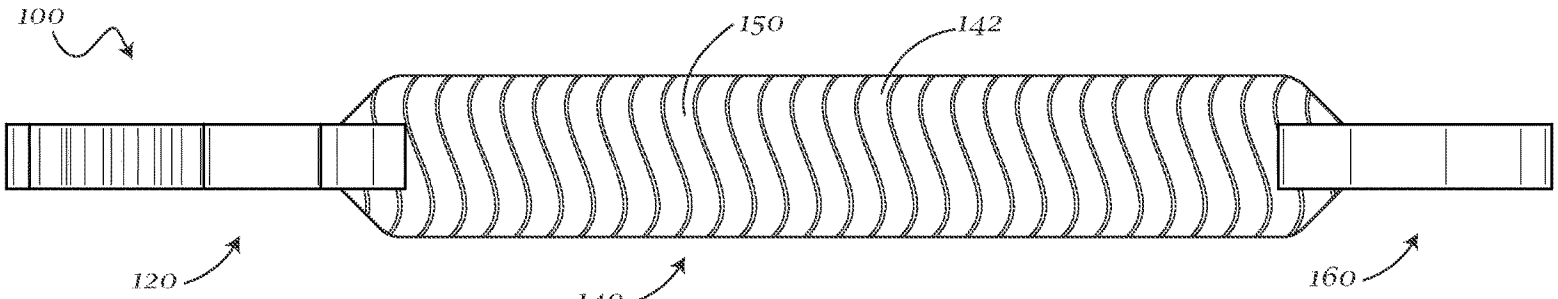
FIG. 28 is a top view thereof.
Figure 29:
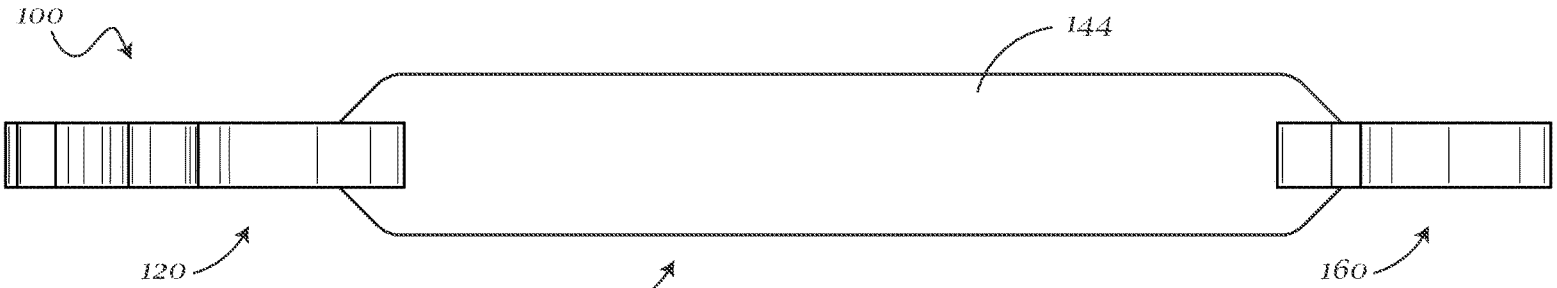
FIG. 29 is a bottom view thereof.
Figure 31:
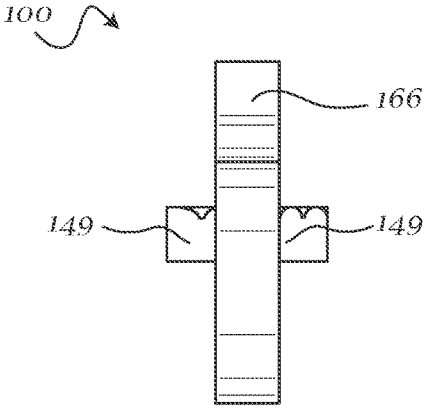
FIG. 31 is a rear view thereof.
Figure 30:
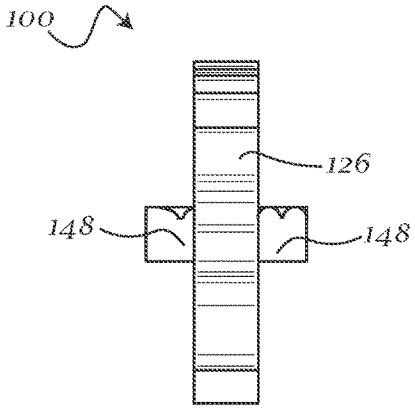
FIG. 30 is a front view thereof.
Figure 32:
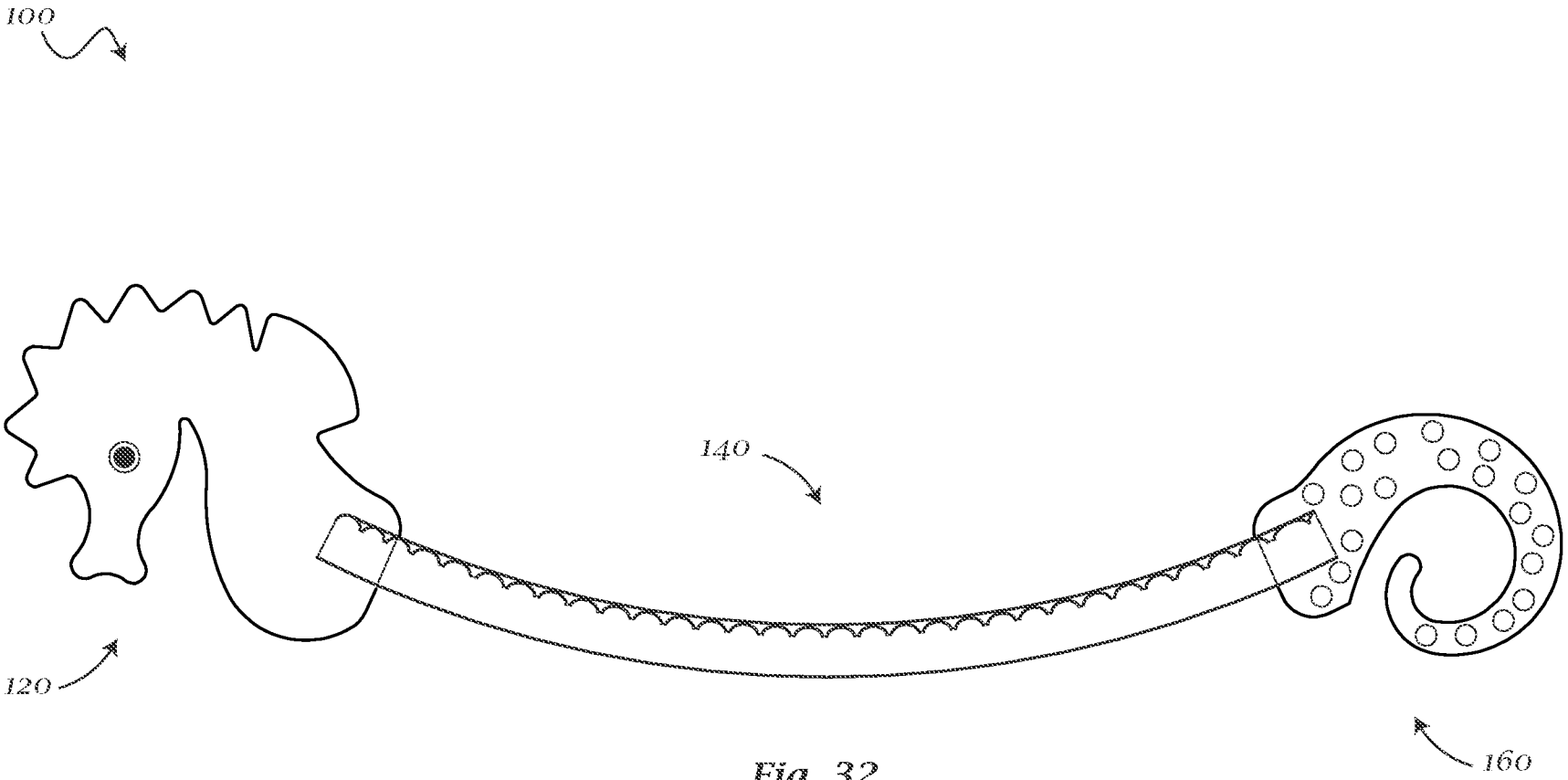
FIG. 32 is a right side view thereof, shown in an alternate orientation.
Figure 33:
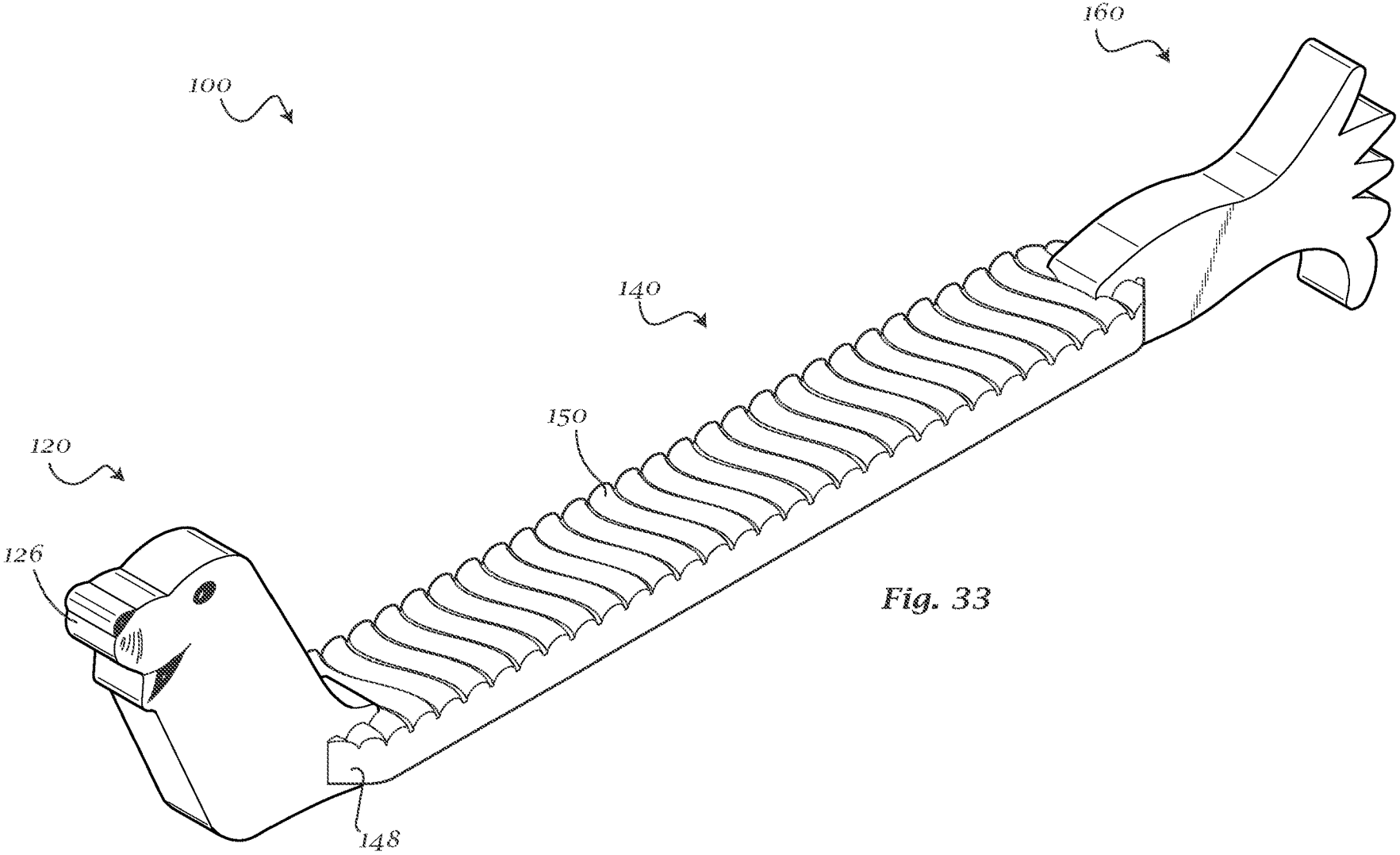
FIG. 33 is a perspective view of another embodiment of a flotation aid.
Figure 34:
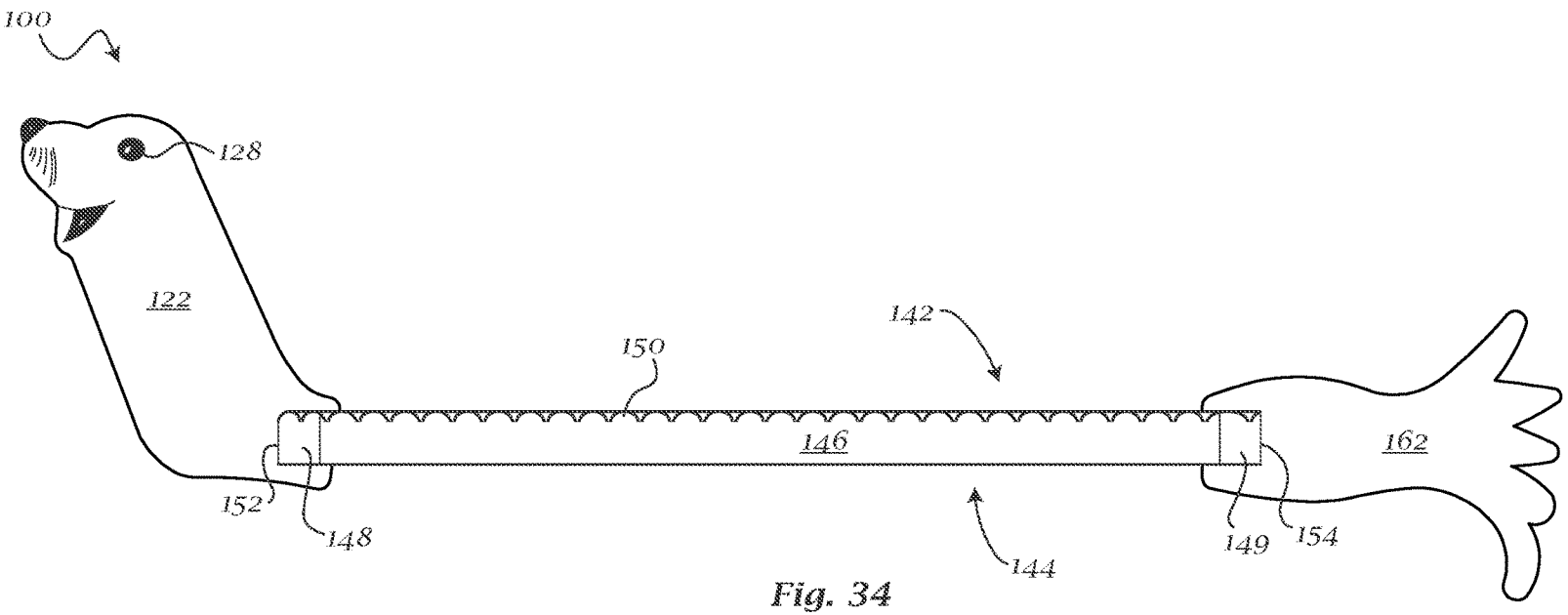
FIG. 34 is a right side view thereof.
Figure 35:
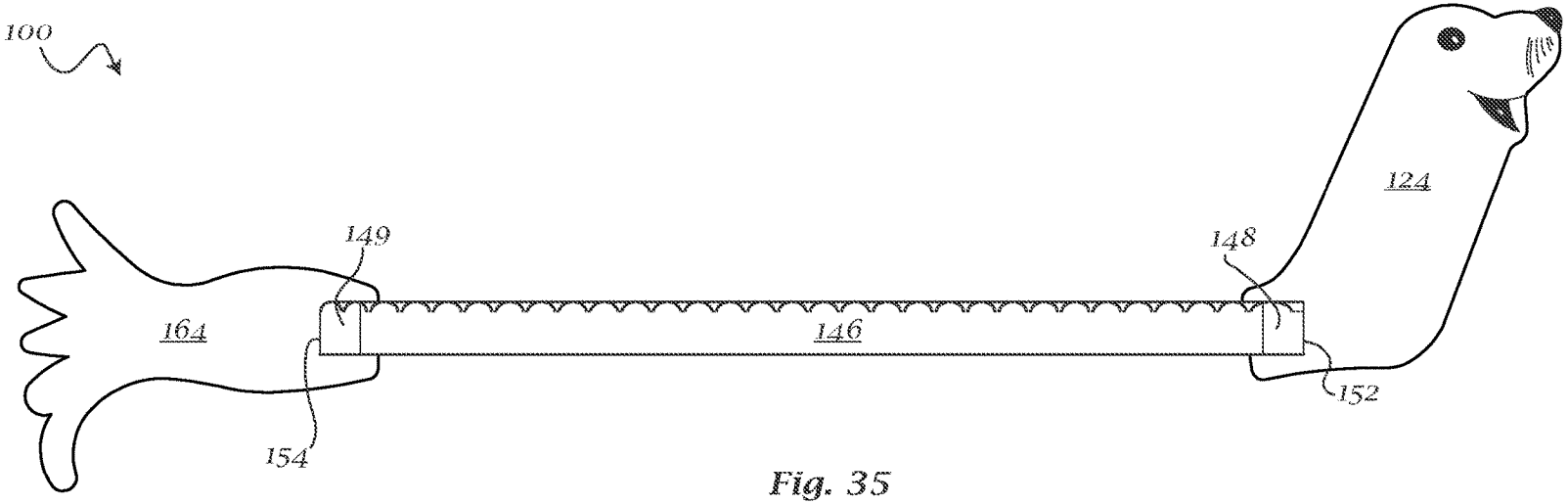
FIG. 35 is a left side view thereof.
Figure 36:
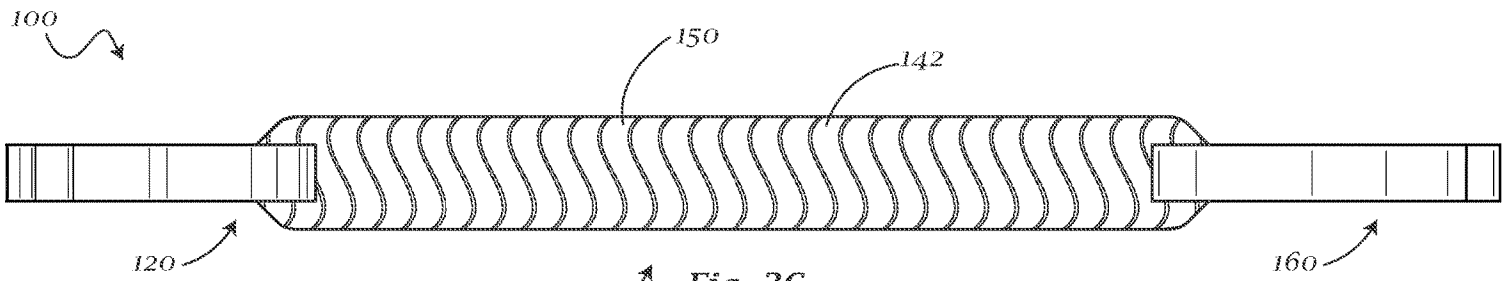
FIG. 36 is a top view thereof.
Figure 37:
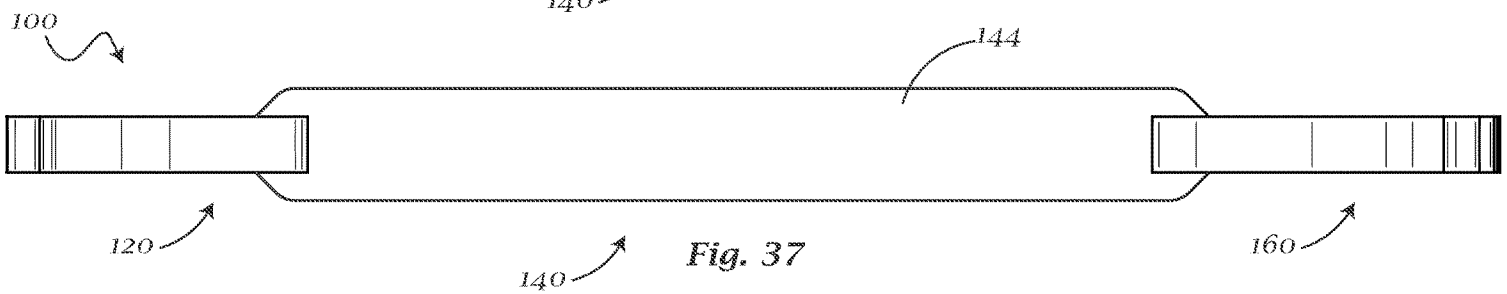
FIG. 37 is a bottom view thereof.
Figure 39:
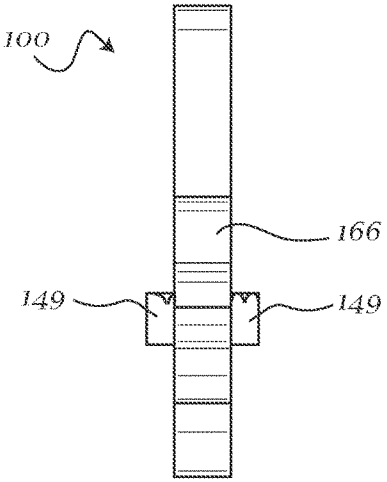
FIG. 39 is a rear view thereof.
Figure 38:
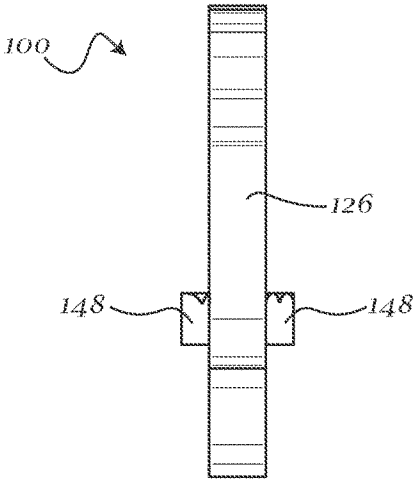
FIG. 38 is a front view thereof.
Figure 40:
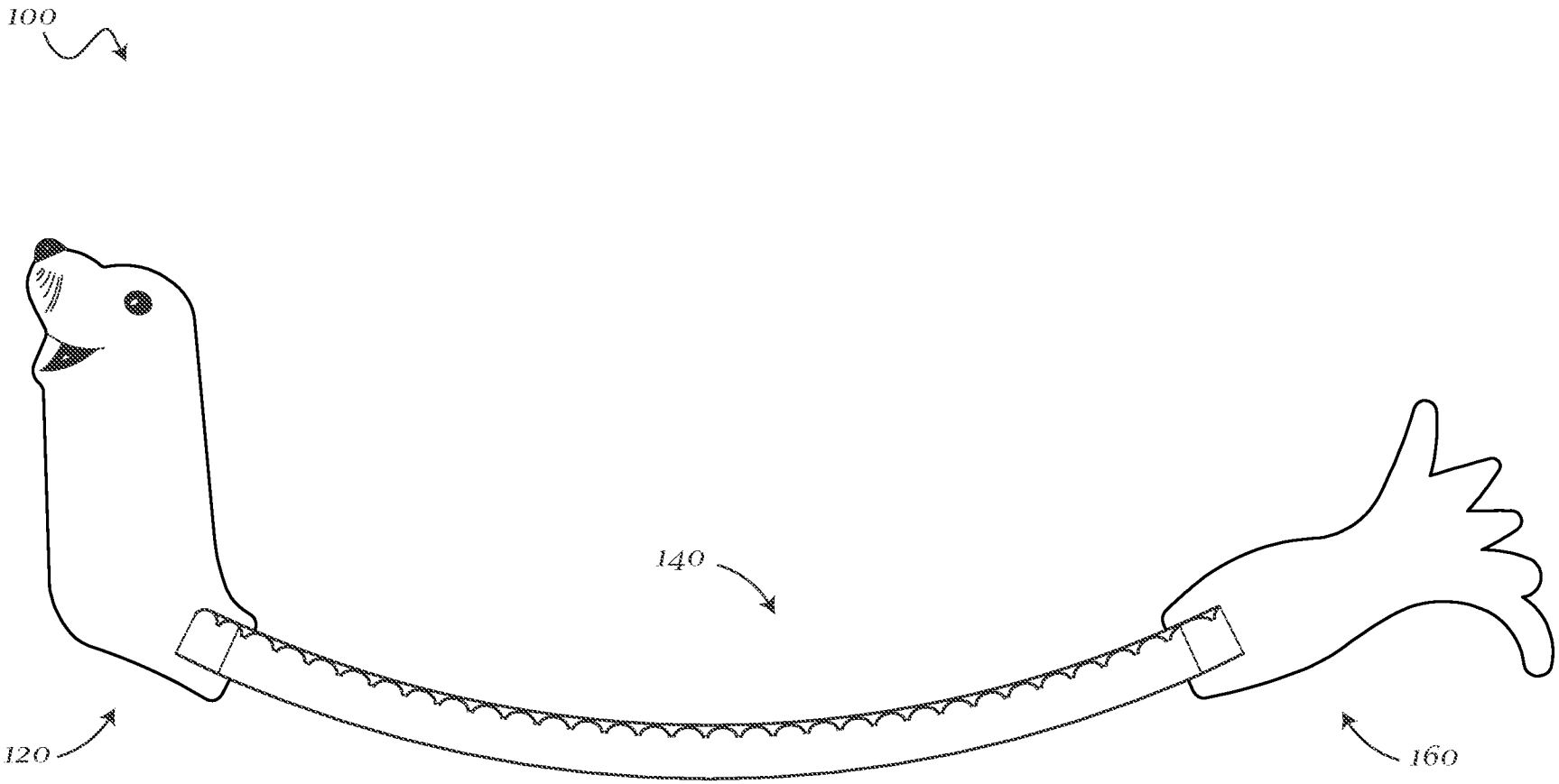
FIG. 40 is a right side view thereof, shown in an alternate orientation.
Figure 41:
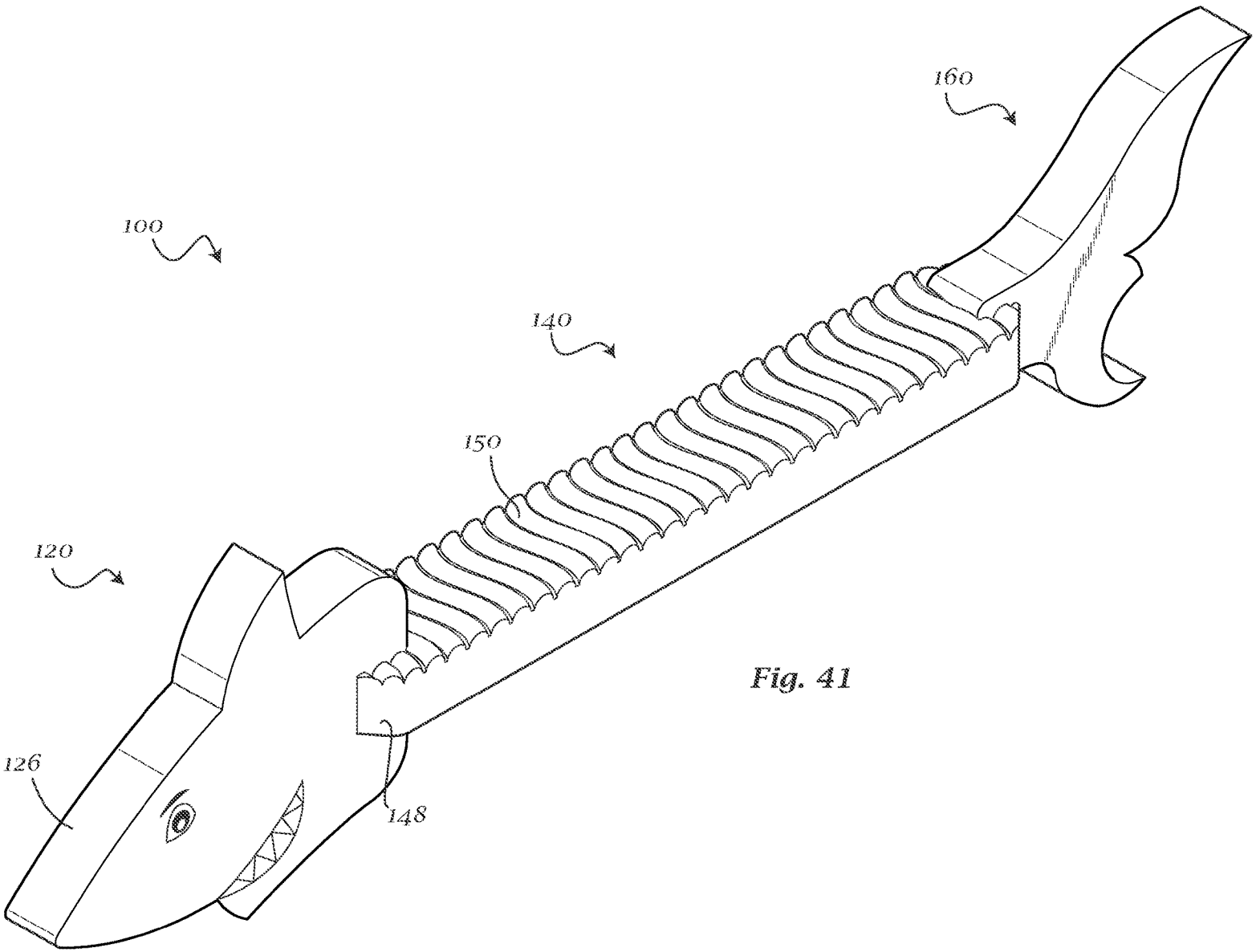
FIG. 41 is a perspective view of another embodiment of a flotation aid.
Figure 42:
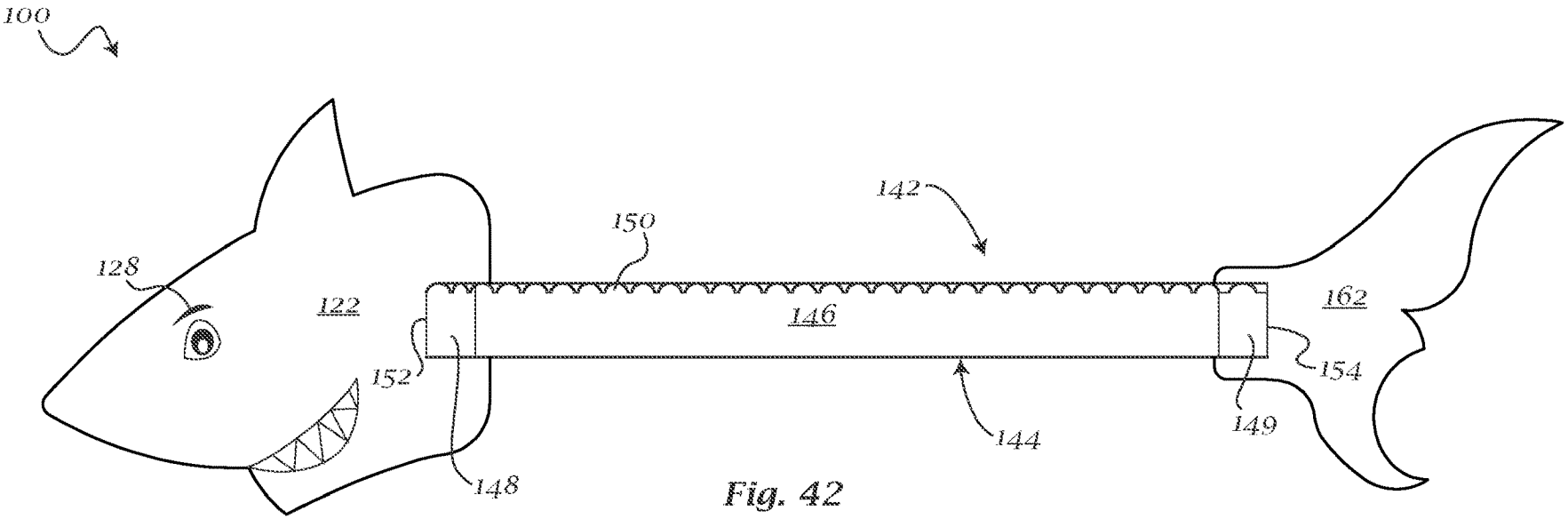
FIG. 42 is a right side view thereof.
Figure 43:
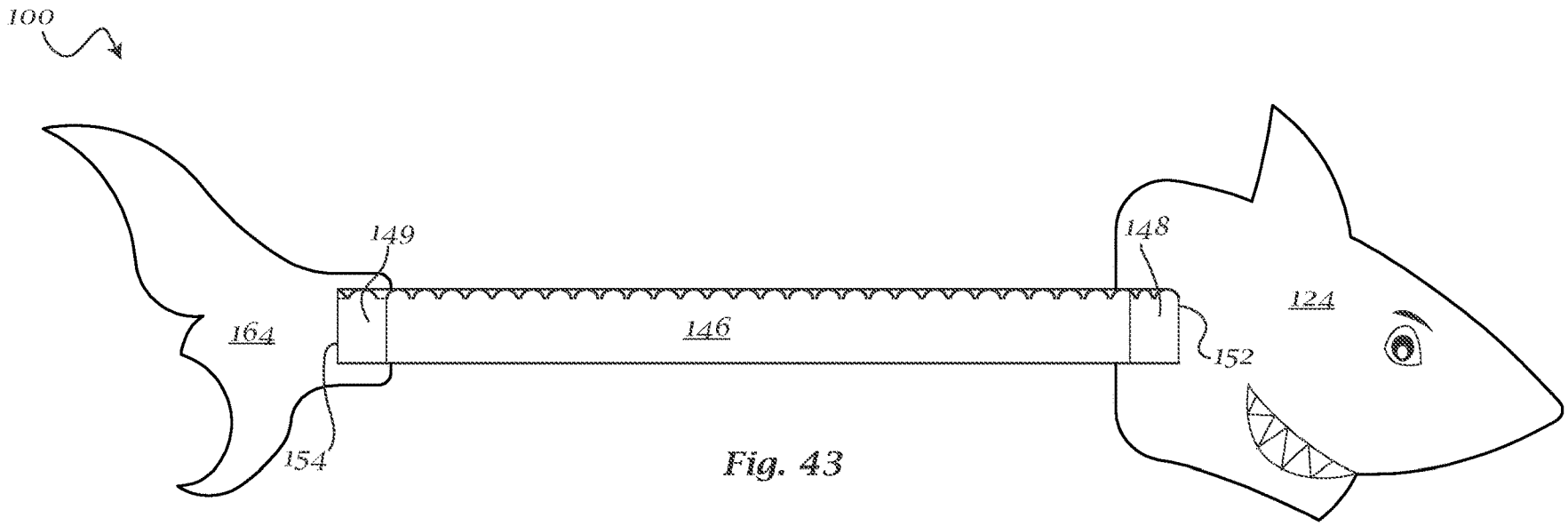
FIG. 43 is a left side view thereof.
Figure 44:
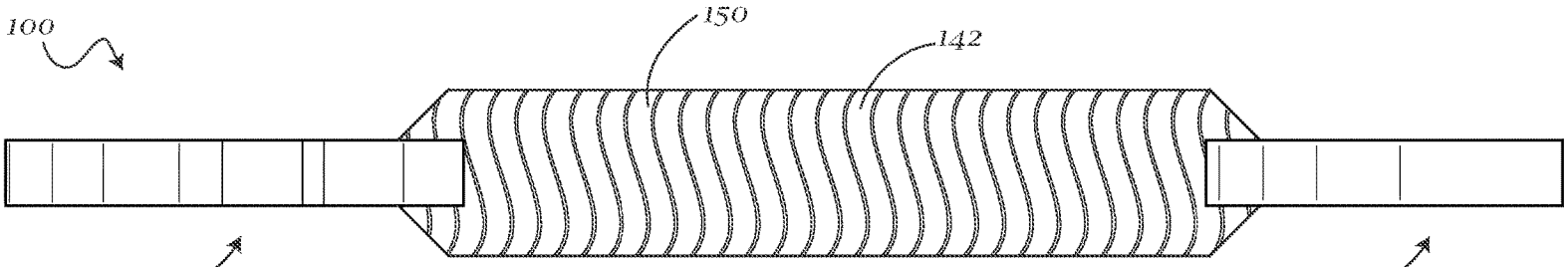
FIG. 44 is a top view thereof.
Figure 45:
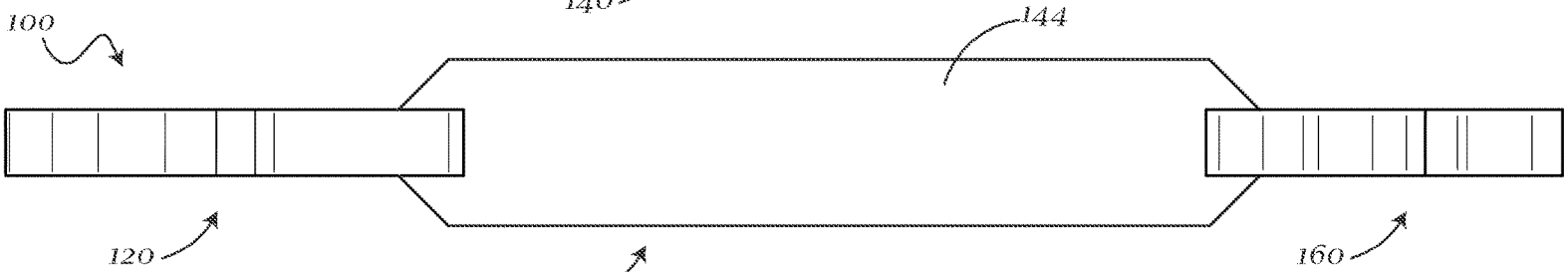
FIG. 45 is a bottom view thereof.
Figure 47:
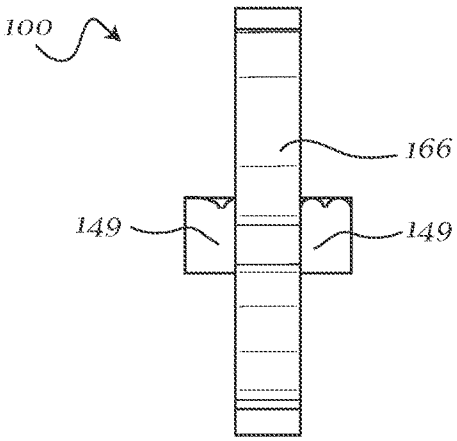
FIG. 47 is a rear view thereof.
Figure 46:
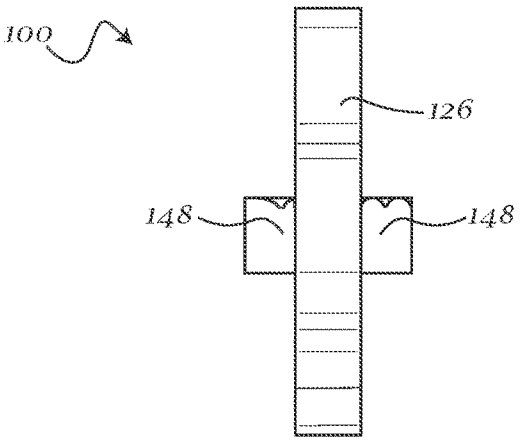
FIG. 46 is a front view thereof.
Figure 48:
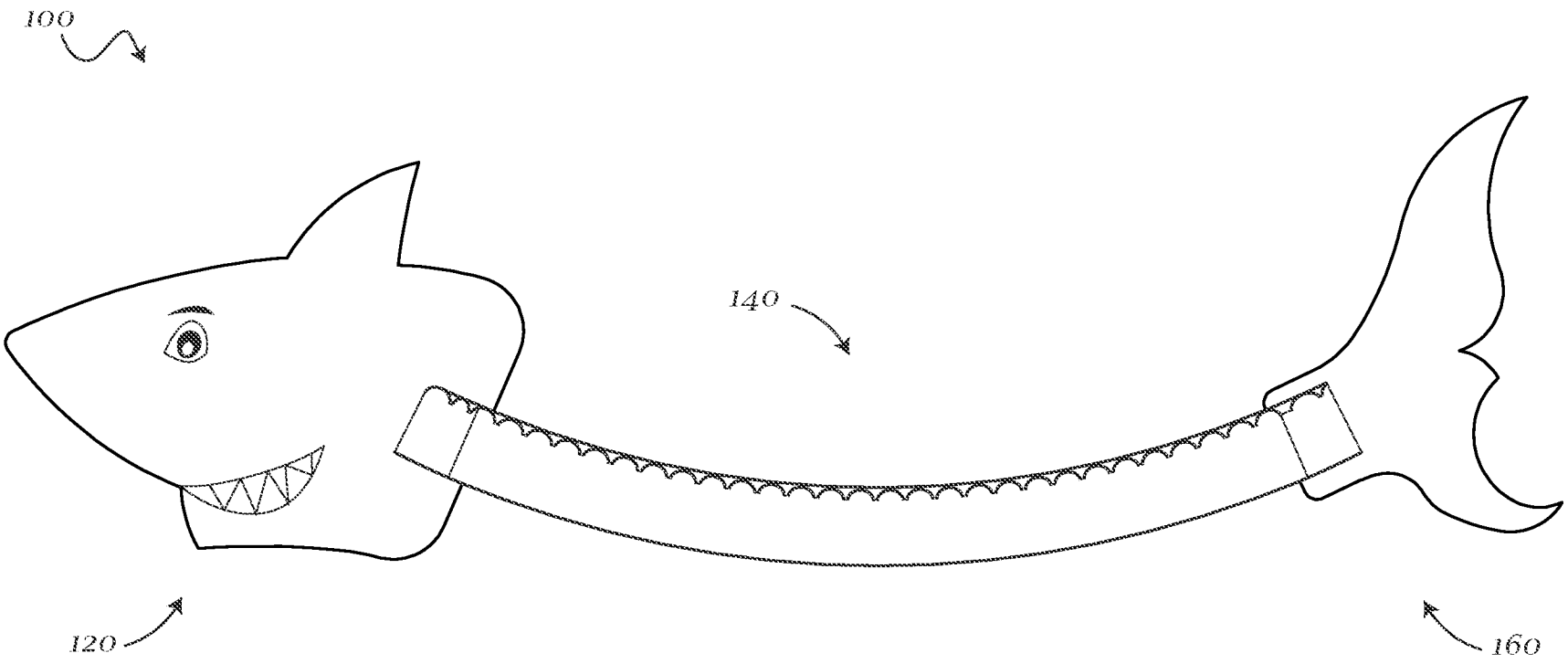
FIG. 48 is a right side view thereof, shown in an alternate orientation.

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiments are not necessarily to be construed as preferred or advantageous over other embodiments. Moreover, the terms "embodiments of the invention", "embodiments" or "invention" do not require that all embodiments of the invention include the discussed feature, advantage or mode of operation.

According to at least one exemplary embodiment and referring to the figures generally, a flotation aid 100 may be provided. Flotation aid 100 may be made of a buoyant material. The flotation aid 100 may have a head portion 120, a central portion 140, and a tail portion 160. Head portion 120 may be substantially shaped in the appearance of an animal head. Tail portion 160 may be substantially shaped in the appearance of an animal tail. Head portion 120 may be connected to or extend from a front edge 152 of central portion 140 and tail portion 160 may be connected to or extend from a rear edge 154 of central portion 140.

Head portion 120 may have a left face 122, right face 124, and wall face 126. Head portion 120 may be oriented in a vertical plane, perpendicular to a plane of central portion 140. Central portion 140 may be oriented in a horizontal plane. Head portion 120 may have surface ornamentation 128 depicting facial features of the animal. Head portion may have a substantially rectangular cross-section. Head portion 120 may have a substantially rectangular cross-section. Left face 122 and right face 124 may be disposed in a plane substantially parallel to sidewalls 146 and substantially perpendicular to a plane of top surface 142 and bottom surface 144, when in a resting state.

Central portion 140 may be a substantially elongated cuboid. Central portion 140 may have a top surface 142, a bottom surface 144, and sidewalls 146. Central portion 140 may have tapered ends 148, which may taper toward a left face 122 and right face 124 of head portion 120. Central portion 140 may also have tapered ends 149, which may taper toward a left face 162 and right face 164 of tail portion 160. Central portion 140 may have a substantially rectangular cross-section.

Central portion 140 may further have plurality of bumps or ribs 150 disposed on or projecting from top surface 142. Ribs 150 may have a semi-circular cross section. Ribs 150 may have a curved or wavy longitudinal axis. According to an exemplary embodiment, ribs 150 may have a substantially S-shaped longitudinal axis. The curved longitudinal axis of ribs 150 may extend substantially transverse to the longitudinal axis of central portion 140. Bottom surface 144 may be substantially smooth.

Flotation aid 100, including head portion 120, central portion 140, and tail portion 160 may be made of a flexible flotation material. Central portion 140 may be flexible. Central portion 140 may bend or flex along a longitudinal axis.

Tail portion 160 may have a left face 162, right face 164, and wall face 166. Tail portion 160 may be oriented in a vertical plane, perpendicular to a plane of central portion 140. Tail portion may have a substantially rectangular cross-section. Left face 162 and right face 164 may be disposed in a plane substantially parallel to sidewalls 146 and substantially perpendicular to a plane of top surface 142 and bottom surface 144, when in a resting state. Tail portion 160 may have surface ornamentation depicting features of the animal.

The intersection of head portion 120 and central portion 140 may form an interlock joint shape. Head portion 120 may project beyond a front edge 152 of central portion 140, such that head portion 120 cuts into central portion 140. Similarly, the intersection of tail portion 160 and central portion 140 may form an interlock joint shape. Tail portion 160 may project beyond a rear edge 154 of central portion 140, such that tail portion 160 cuts into central portion 140.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A flotation aid comprising:

a head portion, wherein the head portion is a three-dimensional, constant thickness approximation of an animal head;

a tail portion, wherein the tail portion is a three-dimensional, constant thickness approximation of an animal tail corresponding to the head portion; and a longitudinally extending elongated central portion connected between the head portion and the tail portion, wherein the elongated central portion has a substantially rectangular cross section, having a first side surface, a second side surface, a flat bottom surface, and a top surface with a plurality of arcuate ribs disposed on the top surface extending transversely in a sinusoidal pattern between and integrally abutting the first side surface and the second side surface of the elongated central portion.

2. The flotation aid of claim 1, wherein the plurality of ribs have a semi-circular cross-section.

3. The flotation aid of claim 1, wherein the head portion and tail portion are oriented perpendicularly to the elongated central portion.

4. The flotation aid of claim 1, further comprising surface ornamentation depicting animal facial features on the head portion.

5. The flotation aid of claim 1, further comprising tapered ends of the elongated central portion at a connection to the head portion and the tail portion.

6. The flotation aid of claim 1, wherein the flotation aid is made of a flotation material.

7. The flotation aid of claim 1, wherein the central portion is configured to bend along a longitudinal axis.

* * * * *